US011408570B2

(12) United States Patent
Luo et al.

(10) Patent No.: US 11,408,570 B2
(45) Date of Patent: Aug. 9, 2022

(54) DOWNLIGHT FIRESTOP

(71) Applicant: URSATECH LTD., Barrie (CA)

(72) Inventors: Xiaoxiong Luo, Barrie (CA); John B. Page, Barrie (CA)

(73) Assignee: URSATECH LTD., Barrie (CA)

( * ) Notice: Subject to any disclaimer, the term of this patent is extended or adjusted under 35 U.S.C. 154(b) by 0 days.

(21) Appl. No.: 16/893,088

(22) Filed: Jun. 4, 2020

(65) Prior Publication Data

US 2021/0025556 A1 Jan. 28, 2021

Related U.S. Application Data

(63) Continuation of application No. 16/130,222, filed on Sep. 13, 2018, now Pat. No. 10,704,751, which is a continuation-in-part of application No. 15/790,711, filed on Oct. 23, 2017, now Pat. No. 10,551,016, which is a continuation of application No. 14/725,458, filed on May 29, 2015, now Pat. No. 9,797,563, which is a continuation-in-part of application No. 14/555,029, filed on Nov. 26, 2014, now Pat. No. 9,803,845.

(51) Int. Cl.

| | |
|---|---|
| ***F21S 8/02*** | (2006.01) |
| ***F21V 25/12*** | (2006.01) |
| ***F21V 29/70*** | (2015.01) |
| ***F21V 23/00*** | (2015.01) |
| *F21Y 115/10* | (2016.01) |

(52) U.S. Cl.

CPC ..... *F21S 8/026* (2013.01); *F21V 25/12* (2013.01); *F21V 25/125* (2013.01); *F21V 29/70* (2015.01); *F21V 23/001* (2013.01); *F21Y 2115/10* (2016.08)

(58) Field of Classification Search

CPC ..... F21S 8/026; F21V 29/70; F21V 25/12; F21V 25/125; F21V 23/001

See application file for complete search history.

(56) References Cited

U.S. PATENT DOCUMENTS

| | | | |
|---|---|---|---|
| 3,955,330 | A | 5/1976 | Wendt |
| 4,137,376 | A | 1/1979 | Clegg et al. |

(Continued)

FOREIGN PATENT DOCUMENTS

| | | | |
|---|---|---|---|
| CA | 2786202 | A1 | 3/2013 |
| CN | 101656304 | B | 9/2011 |

(Continued)

OTHER PUBLICATIONS

Machine-generated English translation by EPO and Google, Description of EP1273841, Züll, Armin, "The invention relates to a fire sleeve", Jan. 8, 2003 (11 pages).

(Continued)

*Primary Examiner* — Rajarshi Chakraborty
*Assistant Examiner* — Nathaniel J Lee

(57) ABSTRACT

An intumescent firestop element is supported within a light can by fire sensitive supports each having a base fabricated of a meltable or flammable material and a supporting element fabricated of metal and supported by the base, with the base joined to the light can. In response to a fire, the fire sensitive supports cease to support the firestop element which drops to a deployed position in the light can until arrested by a limiter.

15 Claims, 38 Drawing Sheets

(56) References Cited

U.S. PATENT DOCUMENTS

| | | | | |
|---|---|---|---|---|
| 4,364,210 | A | 12/1982 | Fleming et al. | |
| 4,513,173 | A | 4/1985 | Merry | |
| 4,630,415 | A | 12/1986 | Attwell | |
| 4,754,377 | A | 6/1988 | Wenman | |
| 4,888,925 | A | 12/1989 | Harbeke | |
| 4,916,800 | A | 4/1990 | Harbeke | |
| 5,058,341 | A | 10/1991 | Harbeke, Jr. | |
| 5,103,609 | A | 4/1992 | Thoreson et al. | |
| 5,129,201 | A | 7/1992 | Robertson et al. | |
| 5,174,077 | A | 12/1992 | Murota | |
| 5,301,475 | A | 4/1994 | Stefely | |
| 5,417,019 | A | 5/1995 | Marshall et al. | |
| 5,452,551 | A | 9/1995 | Charland et al. | |
| 5,887,395 | A | 3/1999 | Navarro et al. | |
| 5,950,376 | A | 9/1999 | Kemeny et al. | |
| 6,105,334 | A | 8/2000 | Monson et al. | |
| 6,176,052 | B1 | 1/2001 | Takahashi | |
| 6,305,133 | B1 | 10/2001 | Cornwall | |
| 6,336,297 | B1 | 1/2002 | Cornwall | |
| 6,412,243 | B1 | 7/2002 | Sutelan | |
| 6,645,278 | B2 | 11/2003 | Langille et al. | |
| 6,694,684 | B2 | 2/2004 | Radke et al. | |
| 6,725,615 | B1 | 4/2004 | Porter | |
| 6,747,074 | B1 | 6/2004 | Buckingham et al. | |
| 6,790,893 | B2 | 9/2004 | Nguyen et al. | |
| 7,080,486 | B2 | 7/2006 | Radke et al. | |
| 7,397,219 | B2 | 7/2008 | Phillips et al. | |
| 7,465,888 | B2 | 12/2008 | Fischer et al. | |
| 7,470,048 | B2 | 12/2008 | Wu | |
| 7,476,010 | B2 | 1/2009 | Johnson | |
| 7,486,047 | B2 | 2/2009 | Phillips et al. | |
| 7,651,238 | B2 | 1/2010 | O'Brien | |
| 7,651,248 | B2 | 1/2010 | Hua | |
| 7,670,033 | B2 | 3/2010 | Steer et al. | |
| 7,812,253 | B2 | 10/2010 | Moselle | |
| 7,913,468 | B2 | 3/2011 | Spais | |
| 7,954,974 | B2 | 6/2011 | Johnson | |
| 8,146,305 | B2 | 4/2012 | Cordts | |
| 8,263,254 | B2 | 9/2012 | Mehta et al. | |
| 8,277,965 | B2 | 10/2012 | Hermann et al. | |
| 8,367,233 | B2 | 2/2013 | Hermann et al. | |
| 8,393,121 | B2 | 3/2013 | Beele | |
| 8,397,452 | B2 | 3/2013 | Stahl, Sr. et al. | |
| 9,089,716 | B2 | 7/2015 | Peterson et al. | |
| 9,797,563 | B2 | 10/2017 | Luo et al. | |
| 9,803,845 | B2 | 10/2017 | Luo et al. | |
| 10,704,751 | B2 * | 7/2020 | Luo | F21S 8/026 |
| 11,015,785 | B1 | 5/2021 | Schubert | |
| 2002/0155348 | A1 | 10/2002 | Gitto | |
| 2004/0016190 | A1 | 1/2004 | Radke et al. | |
| 2004/0100040 | A1 | 5/2004 | Sakno | |
| 2004/0168398 | A1 | 9/2004 | Sakno et al. | |
| 2005/0170238 | A1 | 8/2005 | Abu-Isa et al. | |
| 2006/0096207 | A1 | 5/2006 | Spais | |
| 2006/0234119 | A1 | 10/2006 | Kruger et al. | |
| 2007/0206374 | A1 | 9/2007 | Petrakis et al. | |
| 2008/0011383 | A1 | 1/2008 | Paetow et al. | |
| 2009/0161370 | A1 * | 6/2009 | Johnson | F21V 25/00 362/373 |
| 2009/0218130 | A1 | 9/2009 | Monden et al. | |
| 2010/0024338 | A1 | 2/2010 | Cordts | |
| 2010/0136391 | A1 | 6/2010 | Prilutsky et al. | |
| 2010/0136404 | A1 | 6/2010 | Hermann et al. | |
| 2010/0214790 | A1 | 8/2010 | Wu | |
| 2011/0064997 | A1 | 3/2011 | Peskar et al. | |
| 2011/0088342 | A1 | 4/2011 | Stahl, Sr. et al. | |
| 2011/0262783 | A1 | 10/2011 | Mehta | |
| 2011/0281154 | A1 | 11/2011 | Vissers et al. | |
| 2012/0022201 | A1 | 1/2012 | Zhvanetskiy et al. | |
| 2012/0034501 | A1 | 2/2012 | Hermann et al. | |
| 2012/0231318 | A1 | 9/2012 | Buck et al. | |
| 2012/0233943 | A1 | 9/2012 | Monden et al. | |
| 2012/0304979 | A1 | 12/2012 | Munzenberger et al. | |
| 2013/0061545 | A1 | 3/2013 | Van Walraven et al. | |
| 2013/0086857 | A1 | 4/2013 | Paetow et al. | |
| 2013/0104474 | A1 | 5/2013 | Klein | |
| 2013/0118102 | A1 | 5/2013 | Pilz et al. | |
| 2013/0143076 | A1 | 6/2013 | Sachdev et al. | |
| 2013/0247487 | A1 | 9/2013 | Turner | |
| 2014/0077043 | A1 | 3/2014 | Foerg | |
| 2015/0345758 | A1 | 12/2015 | Highbridge | |
| 2016/0238225 | A1 | 8/2016 | Rashidi Doust | |
| 2016/0238226 | A1 * | 8/2016 | Rashidi Doust | F21V 21/047 |

FOREIGN PATENT DOCUMENTS

| | | | | |
|---|---|---|---|---|
| DE | 19934902 | A1 | 1/2000 | |
| DE | 202012003405 | U1 | 7/2013 | |
| DE | 102013203173 | A1 | 10/2013 | |
| EP | 0635665 | B1 | 3/1997 | |
| EP | 1273841 | A1 | 1/2003 | |
| EP | 2180240 | A1 | 4/2010 | |
| EP | 2572760 | A2 | 3/2013 | |
| GB | 2077382 | A | 12/1981 | |
| GB | 2108614 | A | 5/1983 | |
| GB | 2334770 | A | 9/1999 | |
| GB | 2422191 | A | 7/2006 | |
| GB | 2436139 | A * | 9/2007 | F21S 8/02 |
| GB | 2453950 | A | 4/2009 | |
| GB | 2459538 | A | 11/2009 | |
| GB | 2471929 | A | 1/2011 | |
| GB | 2471929 | A * | 1/2011 | A62C 2/065 |
| GB | 2495009 | A | 3/2013 | |
| GB | 2515649 | A | 12/2014 | |
| GB | 2517222 | A | 2/2015 | |
| KR | 10-2007-0023293 | A | 2/2007 | |
| WO | 97/04838 | A1 | 2/1997 | |
| WO | 2011/124886 | A2 | 10/2011 | |
| WO | 2012/080758 | A2 | 6/2012 | |
| WO | 2013/045937 | A2 | 4/2013 | |
| WO | 2013/145790 | A1 | 10/2013 | |
| WO | 2014/013265 | A1 | 1/2014 | |
| WO | 2020/167127 | A1 | 8/2020 | |

OTHER PUBLICATIONS

Tremco Illbruck Coating Ltd., "B600 Intumescent Pipe Sleeve", Jun. 2010, retrieved Dec. 10, 2013 at http://www.nullifirefirestopping.co.uk/celumdb/documents/Nullifire_B600_DS_GB_19530.pdf, (4 pages).

PFC Corofil, "PFC Corofil Intumescent Conduit", retrieved Dec. 10, 2013 at: http://www.pfc-corofil.com/sites/default/files/products/downloads/pfc_corofil_intumescent_conduit.pdf, (1 page).

Fischer Fixing Systems, "Fischer Conduit intumescent—FCi", retrieved Dec. 10, 2013 at: https://www.byko.is/media/fischer/15_-_fischer_Conduit_Intumescent.pdf, (1 page).

ENIA (Energy Networks & Industrial Applications), "Fire stop barriers FIRE-Stop", retrieved Dec. 10, 2013 at: http://www.enia.gr/wp-content/uploads/2012/07/FireBarriersRaytechCatal_SIGGR.pdf, (7 pages).

The Sparks Direct Blog, "Aurora Fire Rated Downlights: How are they tested and how do they work?", retrieved Sep. 26, 2013 at: http://blog.sparksdirect.co.uk/tag/building-regulations/, (8 pages).

ISE Fire Products & Services Ltd., "Intumescent Fire Protection Products", 2013, retrieved Sep. 26, 2013 at: http://www.isefireproducts.co.uk/intumescent-products, (2 pages).

Kidde Fire Protection Services, "Intumescent Fire Seals Product Range", retrieved Sep. 26, 2013 at: http://www.kiddefps.com/utcfs/ws-407/Assets/Intumescent%20Fire%20Seals.pdf, (31 pages).

Pemko Manufacturing Co., Inc., "Adhesive Gasketing (AG): Adhesive-Backed Fire/Smoke Gasketing", retrieved Sep. 26, 2013 at:http://www.pemko.com/index.cfm?event=products.productListing&searchName=Search+by+Pemko+Product+Number&openFilter=loadPemkoPartNumberSearch&partNumber=s773&partCategoryIds=S773D%3A895, (6 pages).

Trademark Hardware, "Adhesive Weatherstrip, 5/16" Wide Silicone and Intumescent Fin", retrieved at: Sep. 26, 2013 at: http://www.tmhardware.com/Adhesive-Weatherstrip-Gasketing-Intumescent-Fin.html, (2pages).

(56) References Cited

OTHER PUBLICATIONS

Tesla Motors Club, "Amazing Core Tesla Battery IP—18650 Cell" retrieved from web page: http://www.teslamotorsclub.com/showthread.php/17456-Amazing-Core-Tesla Battery-IP . . . ; Nov. 18, 2013 (10 pages).
Proquest Dialog, Flame Retardancy News 14.11 (Nov. 2004), "Great Lakes Intros New Intumescents", retrieved from web page: http://search.proquest.com/professional/docview/671320957/141D2914C631D147EDD/6 . . . ; Nov. 18, 2013 (2 pages).
Machine-generated English translation by EPO and Google, Description of DE102013203173, Chikatimalla, Rajesh, "The invention relates to a wrapping tape for the fire-resistant sealing of pipe passages, with a first and an opposite second side having an intumescent material under heat", Oct. 10, 2013 (29 pages).
Machine-generated English translation by EPO and Google, Description of DE202012003405, Doyma GMBH & CO., "The invention relates to a wrapping tape for the fire-resistant sealing of pipe passages, with a first and an opposite second side having an intumescent material under heat", Aug. 29, 2013 (33 pages).
Machine-generated English translation by EPO and Google, Description DE19934902, Haupt, Gabriele, "The invention relates to a foreclosure of pipes, cables and ducts through walls or ceilings, as well as joints, columns and wall openings", Jan. 27, 2000 (7 pages).
Non-Final Office Action dated Apr. 11, 2022, mailed in the related U.S. Appl. No. 16/709,365.

* cited by examiner

DOWNLIGHT FIRESTOP

CROSS-REFERENCE TO RELATED APPLICATIONS

This application is a continuation application of U.S. patent application Ser. No. 16/130,222, filed Sep. 13, 2018, which is a continuation-in-part of U.S. patent application Ser. No. 15/790,711, filed Oct. 23, 2017, which application is a continuation application of application Ser. No. 14/725,458, filed May 29, 2015, which application is a continuation-in-part application of application Ser. No. 14/555,029, filed Nov. 26, 2014, the contents of these prior applications are incorporated herein by reference.

BACKGROUND

This relates to a firestop element for a downlight and to a downlight incorporating a firestop element.

When a fire breaks out in a building, it should be contained as much as possible. While a ceiling in a building may be designed to impede the spread of fire, openings through the ceiling for downlights present an opportunity for a fire to spread more easily. Also, the downlights themselves can be the cause of a fire.

Therefore, there is a need for an approach to reduce the fire hazards associated with downlights.

SUMMARY

A firestop element is provided which is fabricated from a polymer intumescent composition. The element may be associated with a light can of a downlight. In some embodiments, the firestop element will drop to a deployed position in the light can in the event of a fire.

In accordance with an embodiment, there is provided a downlight fixture comprising: a light can; a firestop element supported on or within said light can by at least one fire sensitive support, said firestop element fabricated of a polymer intumescent composition, said at least one fire sensitive support, in response to a fire, ceasing to support said firestop element such that said firestop element is freed to drop to a deployed position; and light can further having an limiter to limit a drop of said firestop element.

Other features and advantages will become apparent from the following description in conjunction with the drawings.

BRIEF DESCRIPTION OF THE DRAWINGS

In the figures which illustrate example embodiments.

DETAILED DESCRIPTION

Figure 1:
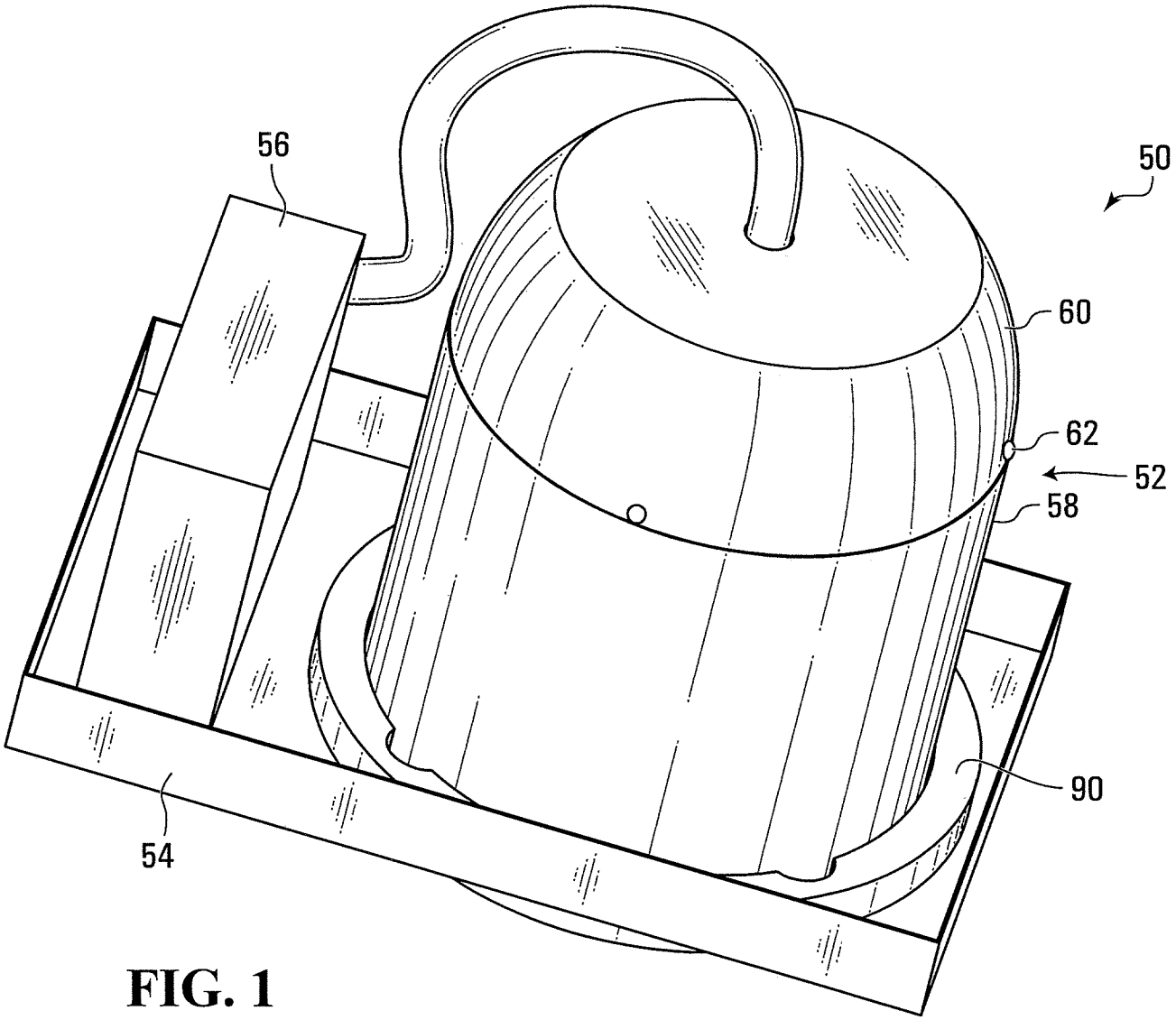
FIG. 1 is a top perspective view of a downlight fixture in accordance with a first embodiment.
Figure 2:
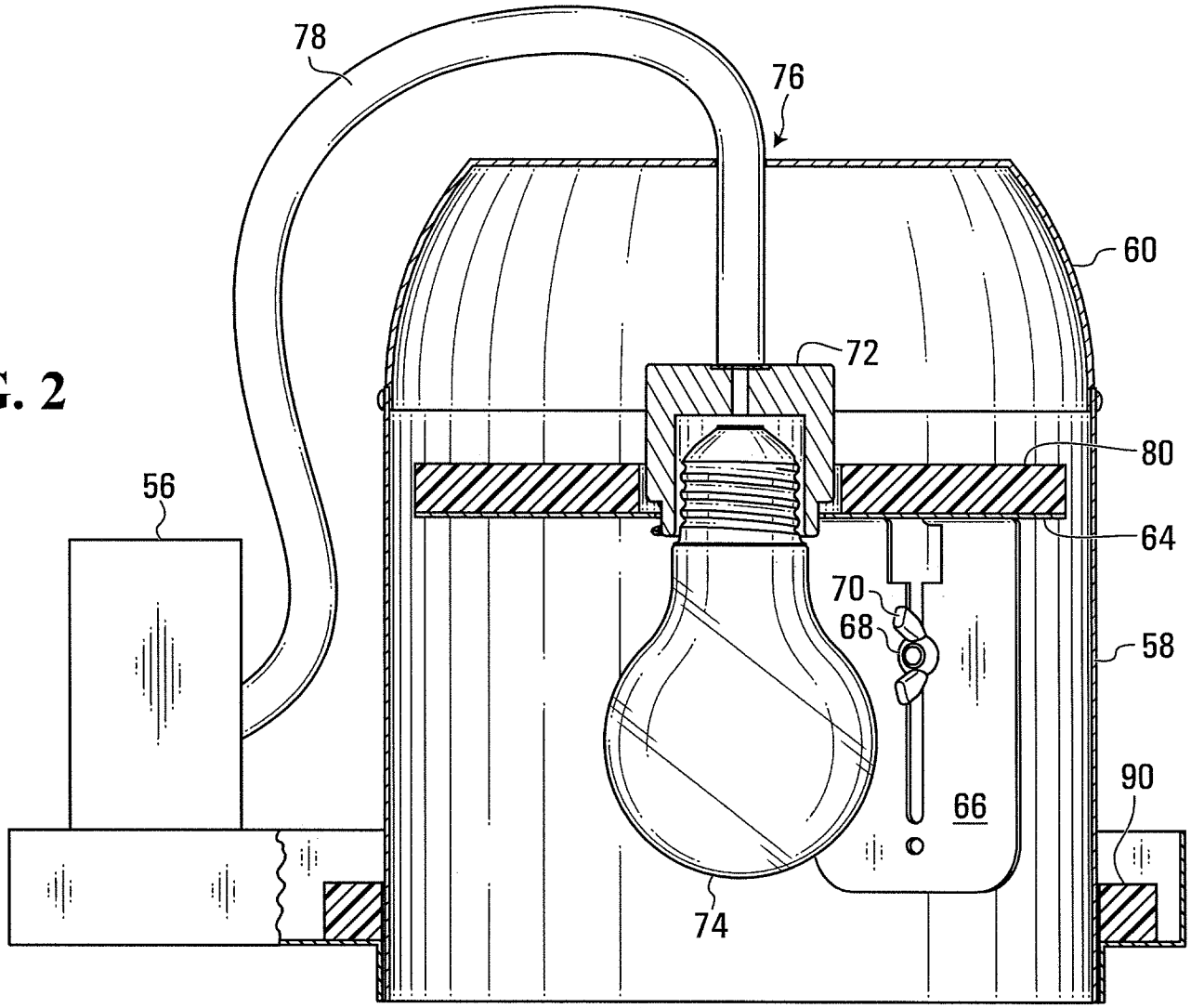
FIG. 2 is partially sectioned side view of the downlight fixture of FIG. 1.

Turning to FIGS. 1 and 2, a downlight fixture 50 has a metal light can 52 joined to a rectangular metal base 54. The base also supports wiring box 56 which, if the light fixture is used with an electrical gas discharge light, may also include a ballast. The light can 52 has a body 58 shaped as a cylindrical sleeve and an end cap 60 which is joined to the body by rivets 62. A support plate 64 disposed within the light can has a depending slotted tongue 66 that rides on a threaded peg 68 projecting radially inwardly from body 58. A wing nut 70 received on the threaded peg frictionally clamps the slotted tongue to the light can body 58. By loosening the wing nut, the slotted tongue 66 may be slid along the peg 68 to adjust the height of the plate 64 within the light can. A light mount, namely socket 72, is mounted to the plate 64 and a light bulb 74 may be screwed into the light socket. The light can end cap 60 has a central opening 76 through which an electrical conductor 78, originating at the wiring box 56, extends.

Figure 3:
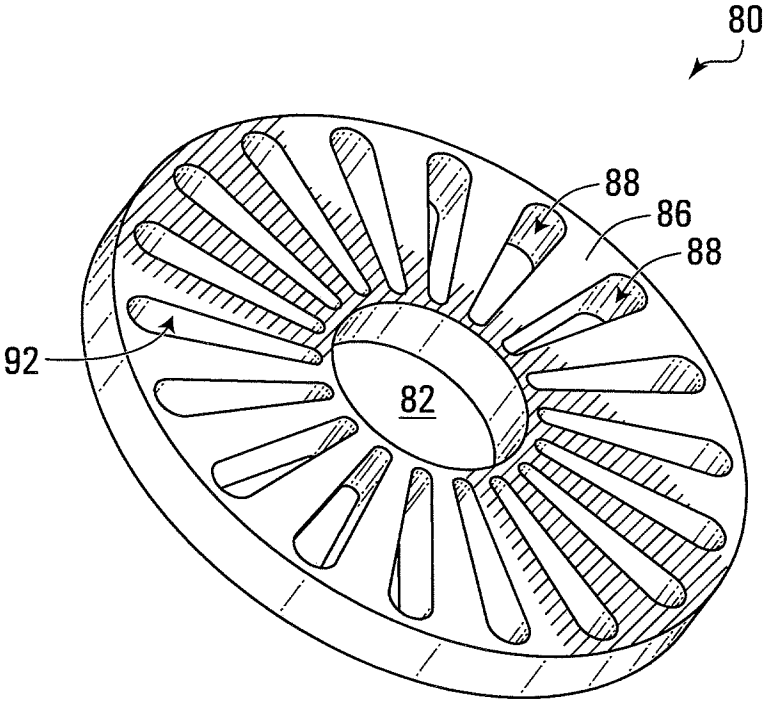
FIG. 3 is a bottom perspective view of a firestop element of the downlight fixture of FIG. 1.

A firestop element 80 is supported on the plate 64. Element 80 has a diameter similar to the inside diameter of the light can body 58. Turning to FIG. 3, the firestop element is an annular disk with a central opening 82. The disk has a plurality of regularly spaced lands 86 on a face of the disk with a void 88 extending between each pair of lands. The voids are in the nature of radially elongated axial through slots to define a plurality of identical regularly spaced radially extending ribs 92, with a rib between each pair of slots. The bottom surface of the ribs are the lands and the ribs connect to each other at the outer and inner peripheries of the annular disk. The central opening 82 allows the element to be fitted over the light socket 72.

A firestop ring 90 may extend about the base of the light can 52 and be supported on rectangular base 54.

Both the firestop element 80 and firestop ring 90 are fabricated of an intumescent flame retardant (IFR) that includes one or more IFR polymer composites. The firestop element may be rigid or elastomeric. Suitable IFR polymer composites may include base polymers, fire retardants, and blowing agents. If the base polymers are inherently fire retardant, such as polyvinyl chloride (PVC), chlorinated polyvinyl chloride (CPVC), halogenated polyethylene Neoprene and phenolic resin, then the fire retardants can be omitted from the composite. Synergists such as antimony oxides and/or zinc borate can be added to improve the fire retardancy of a composite. Char-forming agents can be added to promote charring and increase yield (i.e., final volume after intumescence), and thereby improve the fire retardancy and thermal insulation of a composite. Optionally, other components such as smoke suppressants, pigments, and compatibilizers such as maleic anhydride grafted polyolefin and organofunctional silanes can also be added.

Suitable blowing agents include, but are not limited to, expandable graphites, intumescent hydrated alkali metal silicates, and intumescent hydrated alkali metal silicates with certain amounts of other components such as those described in U.S. Pat. No. 6,645,278, the contents of which are incorporated herein by reference. The start expansion temperature (SET) of suitable blowing agents may vary between 120° C. to 350° C., which is well above the normal operating temperature of the downlight fixture. Other suitable blowing agents will also be apparent to those of ordinary skill in the art. Blowing agents in the composite are generally used in amount of about 1 weight percent (wt %) to about 70 wt %.

Suitable fire retardants include, but are not limited to, polymeric halogen, monomeric halogen, alumina trihydrate, magnesium di-hydroxide, mica, talc, calcium carbonate, hydroxycarbonates, phosphorus compounds, red phosphorus, borate compounds, sulfur compounds, nitrogen compounds, silica, and/or various metal oxides. Other suitable fire retardants will also be apparent to those of ordinary skill in the art. The concentration of the fire retardants in a composite generally varies from 5 wt % to 55 wt %.

Suitable base polymers include, but are not limited to, thermoplastics, such as polyethylene, polypropylene, polyamide, ABS, polybutylene terephthalate, polyethylene terephthalate, EVA, thermosetting plastics, and elastomers, such as epoxy, Neoprene, cross-linked polyethylene, silicone, NBR, thermoplastic elastomers, or the blend of above. Other suitable base polymers will be apparent to those of ordinary skill in the art.

A mixture of the different components described above can be compounded into a composite. This composite can in turn be formed into desired geometries by known polymer processing methods such as injection molding, compression molding, transfer molding, or the like. The melting temperature of the base polymers should be lower than the SET of the blowing agents in the composite and higher than the normal operating temperatures expected in the downlight fixture. The temperature between the melting temperature of the base polymers and the SET of the blowing agents is the processing window for the composite. An IFR polymer composite formulated to have an expansion ratio of between 1.2 and 50 is suitable.

Example suitable IFR polymer composites are described in U.S. Pat. No. 6,790,893 issued Sep. 14, 2004 to Nguyen et al., the contents of which are incorporated herein by reference, US2010/0086268 to Reyes, published Apr. 8, 2010, the contents of which are incorporated herein by reference, and US2012/0022201 to Zhvanetskiy et al., published Jan. 26, 2012, the contents of which are incorporated herein by reference.

In normal operation, the voids 88 of element 80 assist in allowing heat to dissipate in the light can. However, if the temperature in the ceiling rises, the polymer in the composite of firestop elements 80 and 90 may begin to soften. In this instance, base 54 will support element 90 and plate 64 will support element 80. If the temperature reaches the SET of the blowing agents of the composite, the elements 80 and 90 will begin to expand and melt forming an outer layer of char. In this regard, the voids 88 and ribs 92 of element 80 increase the surface area of the disk as compared with that of a solid disk. In consequence, the IFR material of element 80 will react more quickly if the external temperature reaches the SET temperature, and therefore expand more quickly, than would similar IFR material of a similarly sized solid disk.

The thickness of element 80 and the volume of material of the element are chosen so that element 80 will expand to plug the top of the light can 52. Element 90 is sized so that it will expand to close off any gap between base 54 and light can 52 as well as the gap between the light can 52 and the opening through the ceiling.

The layer of char formed during charring of elements 80 and 90 provides a thermal insulation barrier that helps minimize heat transfer. Char formation can also provide a barrier that reduces volatile gas formation within the IFR composition and separates oxygen in the gas that is formed from the underlying (burning) substrate. Thus, the char forming on burning of the IFR composition can result in a shorter burning time for some IFR compositions.

Flames from any fire below the downlight fixture will therefore be blocked from licking up the outside the light can or up through the hole 76 in the top of the can by the expanded elements. Also, the resultant thermal insulating plugs in and around the can will reduce the temperature at the top of the can, therefore reducing the likelihood of combustion of materials above and/or around the light can.

It will be apparent that firestop element 80 could have a different pattern of lands and voids and still assist in heat dissipation in the light can during normal operation as well as presenting an increased surface area that would increase the speed of intumescence. Thus, it will be apparent to those of skill in the art that element 80 may have other surface patterns.

A number of further embodiments are contemplated where each of these further embodiments has at least one firestop element with a composition as has been described for firestop elements 80 and 90.

Figure 4:
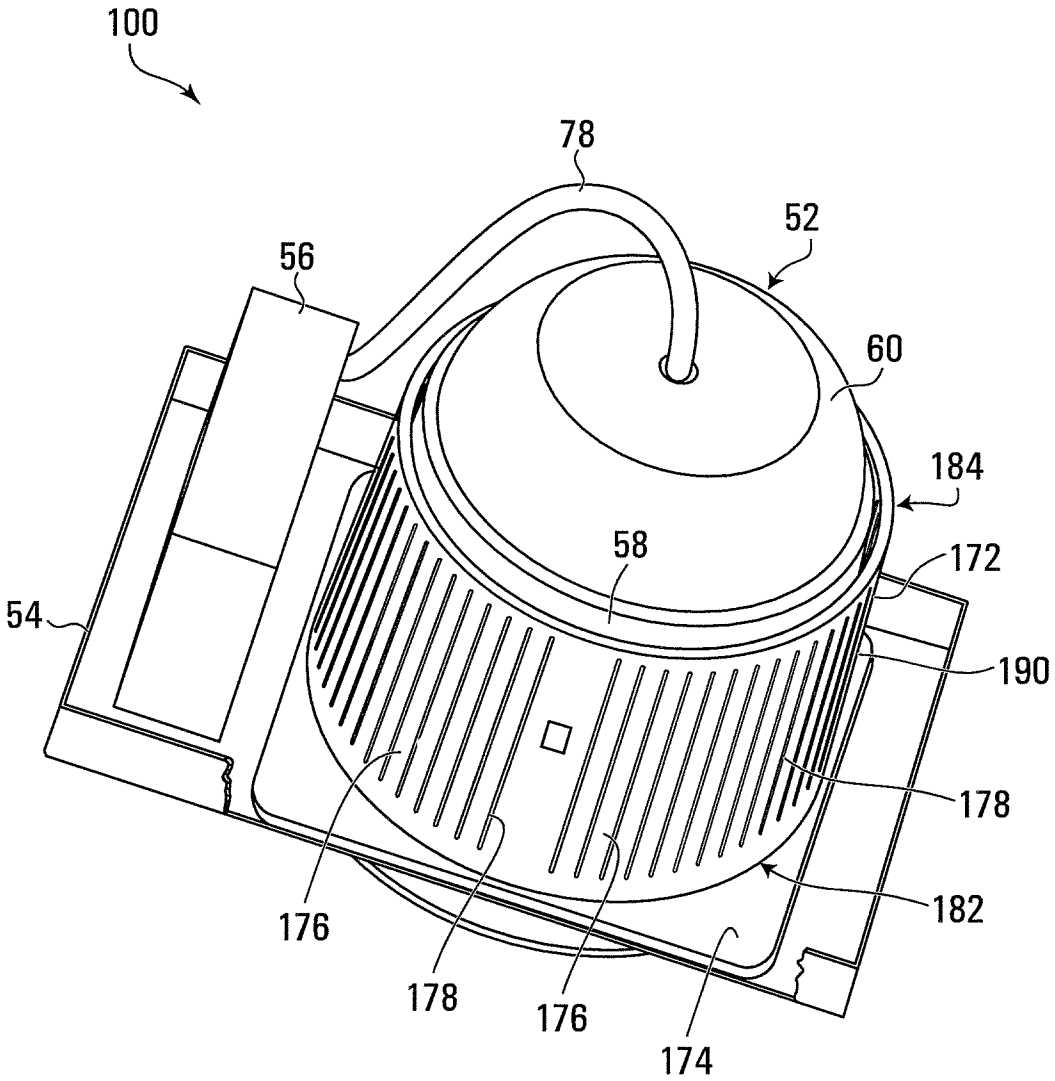
FIG. 4 is a partially cut away top perspective view of a downlight fixture in accordance with a second embodiment.

FIG. 4 illustrates a further embodiment where downlight fixture 100 differs from downlight fixture 50 of FIGS. 1 to 3 in the addition of a firestop sleeve 190 in place of the firestop ring 90 of FIGS. 1 to 3. In FIG. 4, like parts to those of downlight fixture 50 of FIGS. 1 to 3 have been given like reference numerals, and reference should be made to the foregoing description of downlight fixture 50 for a description of these parts and their function. Sleeve 190 has a sleeve portion 172 surrounding the body 58 of the light can 52 and a plate-like base 174 sitting atop the base 54 of the fixture 100. The sleeve portion 192 has a plurality of axially elongated ribs 176 between axially elongated radially opening slots 178. The sleeve tapers from a wider end 182 at plate-like base 174 to a narrower end 184 at end cap 60 of the light can 52. The angle of taper may be anywhere in the range of two to ten degrees. The sleeve 190 may be made of the afore-described intumescent material.

In normal operation, the slots 178 allow heat to dissipate from the light can such that the sleeve 190 does not significantly decrease the rate of heat dissipation from the light can. If downlight fixture 100 is exposed to a fire, the firestop sleeve will first soften, and then intumesce. The ribs 176 increase the surface area of the firestop sleeve 190 which speeds its reaction time. Because of the taper of the sleeve, when it softens it may collapse inwardly onto the outer surface of the light can. In such instance the light can 52 will support the sleeve while it intumesces. In addition, the firestop disk (not shown) within the can 52 intumesces, as afore-described in connection with the first embodiment.

In the event that firestop sleeve 190 intumesces due to a fire, it will seal up the interface between the light can 52 and base 54 and will also seal off openings in the body 58 of the light can 52. The expansion ratio of the sleeve can be chosen to be sufficiently high that the intumesced sleeve can plug the opening in the ceiling.

FIGS. 5 to 9 illustrate a further embodiment of a downlight fixture. In figures FIGS. 5 to 9, like parts to those of downlight fixture 50 of FIGS. 1 to 3 have been given like reference numerals, and reference should be made to the foregoing description of downlight fixture 50 for a description of these parts and their function.

Figure 5:
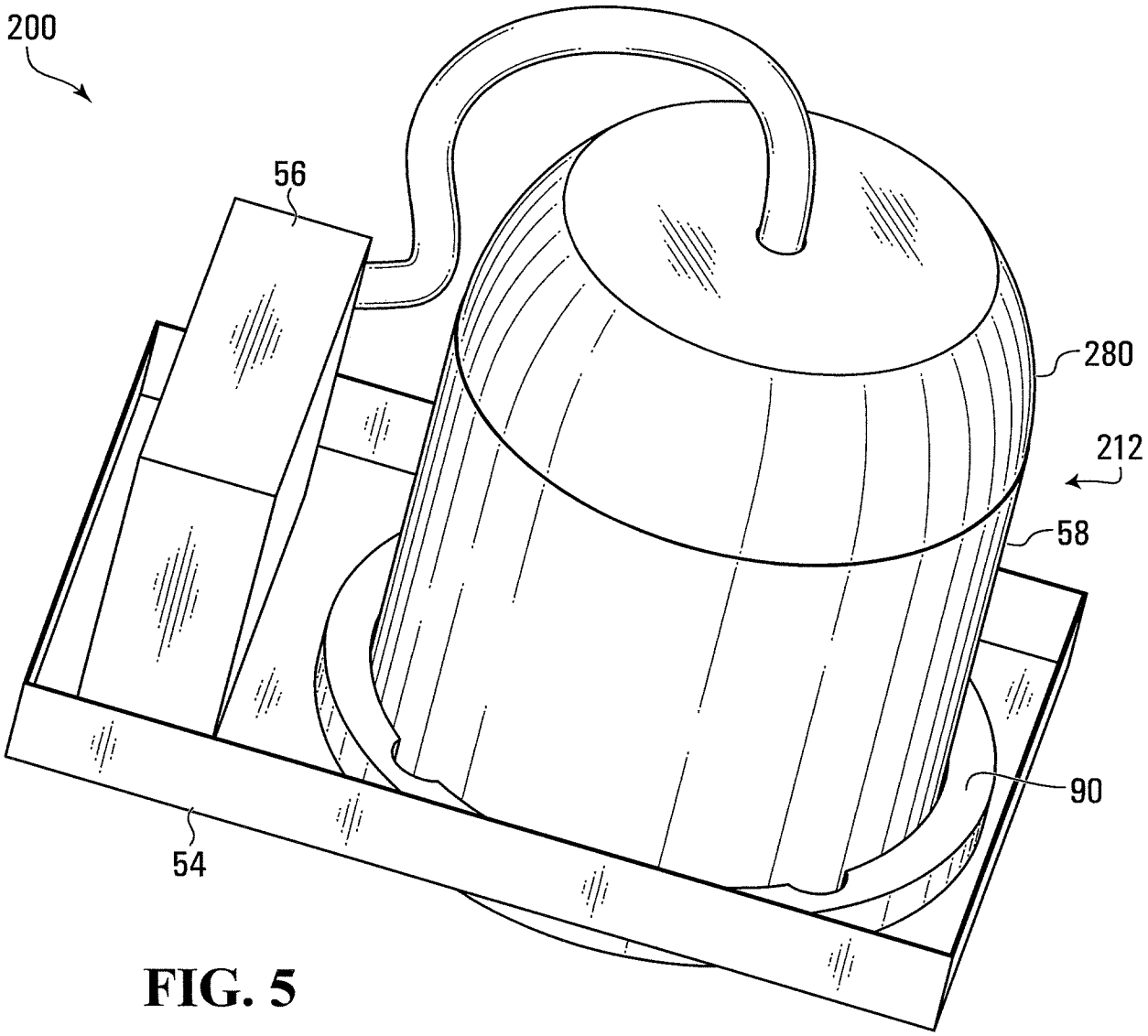
FIG. 5 is a top perspective view of a downlight fixture in accordance with another embodiment.
Figure 6:
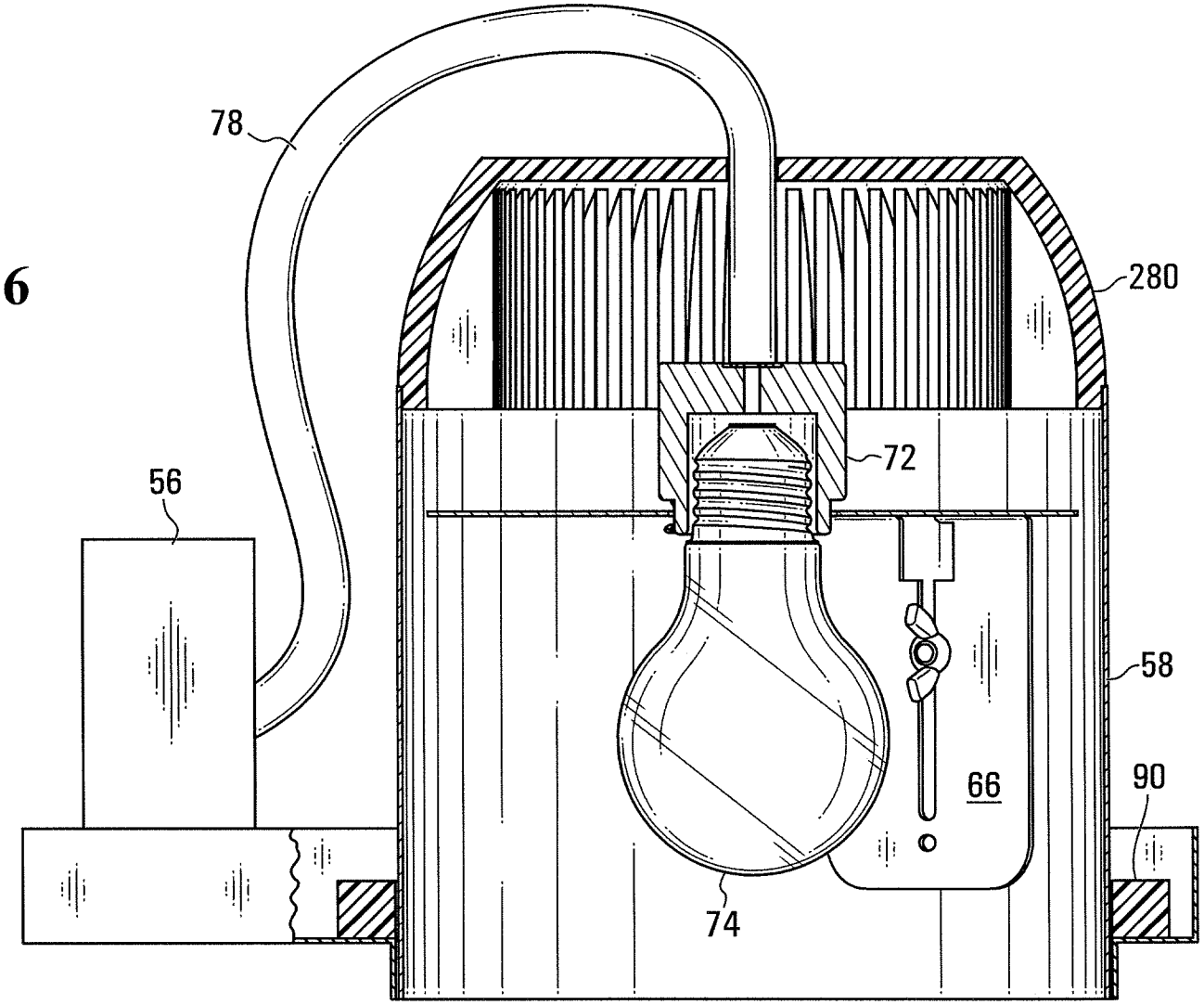
FIG. 6 is partially sectioned side view of the downlight fixture of FIG. 5.

Turning to FIGS. 5 and 6, downlight fixture 200 has a rigid firestop element 280 that is the end cap for the light can 212. Element 280 is joined to the cylindrical metal body 58 of the light can in any suitable fashion, such as by rivets.

Figure 8:
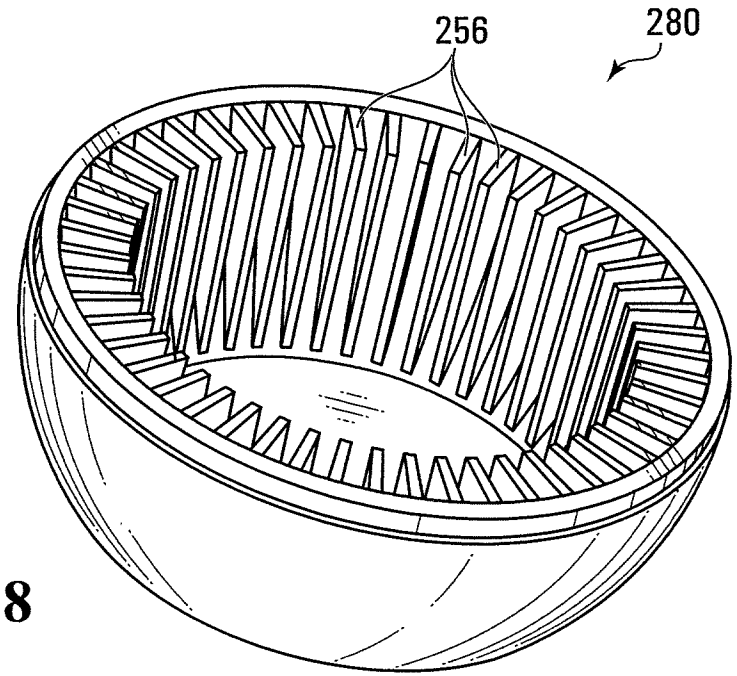
FIG. 8 is a bottom perspective view of the firestop element of FIG. 7.
Figure 7:
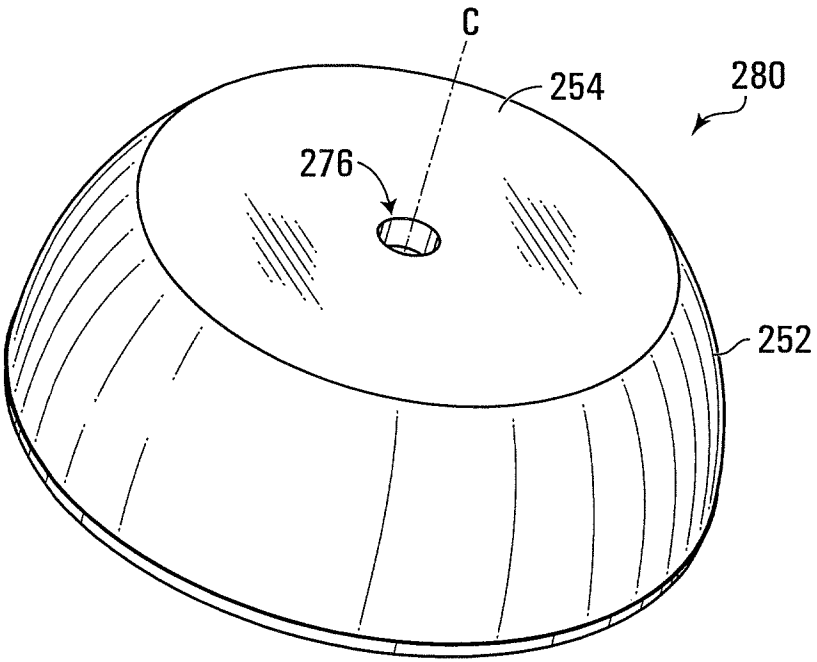
FIG. 7 is a top perspective view of a firestop element of the downlight fixture of FIG. 5.
Figure 9:
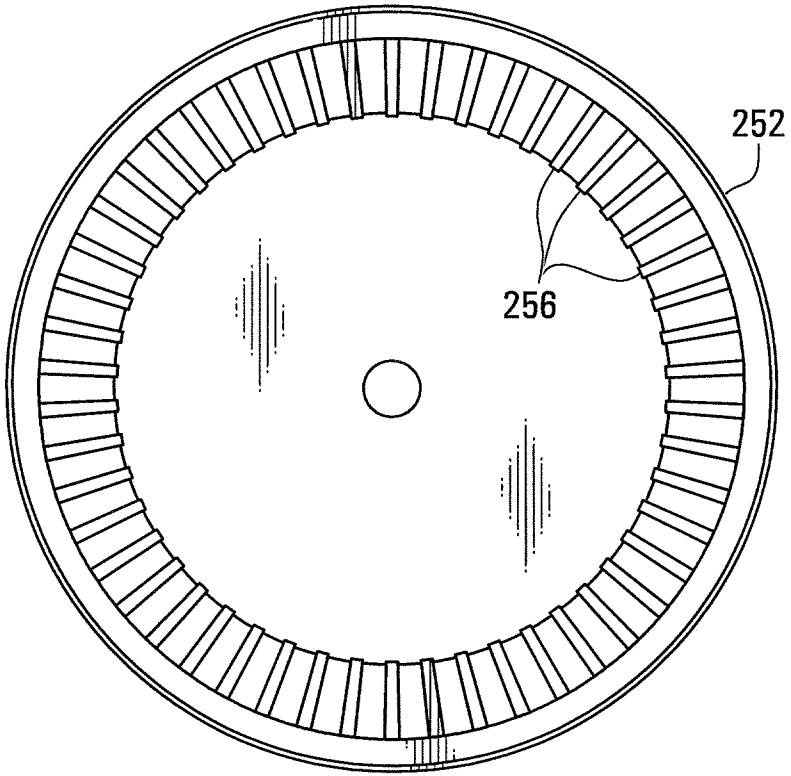
FIG. 9 is a bottom view of the firestop element of FIG. 7.

Turning to FIGS. 7 to 9, firestop element 280 has an annular sidewall 252 and a top wall 254. The annular sidewall has a plurality of identical regularly spaced inwardly projecting ribs 256 shaped as fins. The fins project radially inwardly toward a central axis, C, of the annular sidewall 252 and are aligned with this central axis. The annular sidewall tapers toward the top wall and the fins commensurately taper such that the fins have a constant radial inward extent. The top wall 254 has a medial hole 276 to accommodate electrical conductor 78 (FIG. 6).

In use, in normal operation, ribbed element 280 allows a greater rate of heat dissipation from the light can than would a solid element having the same extent. In the event of fire, if the temperature of the element 280 exceeds the SET, the element expands to plug the top of the light can and char is formed to provide a thermal barrier. As with firestop element 80 (FIG. 3), the surface area of element 280 is increased by the provision of the spaced ribs 256 and so the speed of intumescence is increased as compared with that of a solid element.

Element 280 may soften as its temperature increases beyond the normal operating temperatures of fixture 200 but remains below SET. However, in this instance, the dome shape of element 280 assists in resisting sag.

The ribs 256 of element 280 could be replaced by other projections that increase the surface area of the element.

Figure 10:
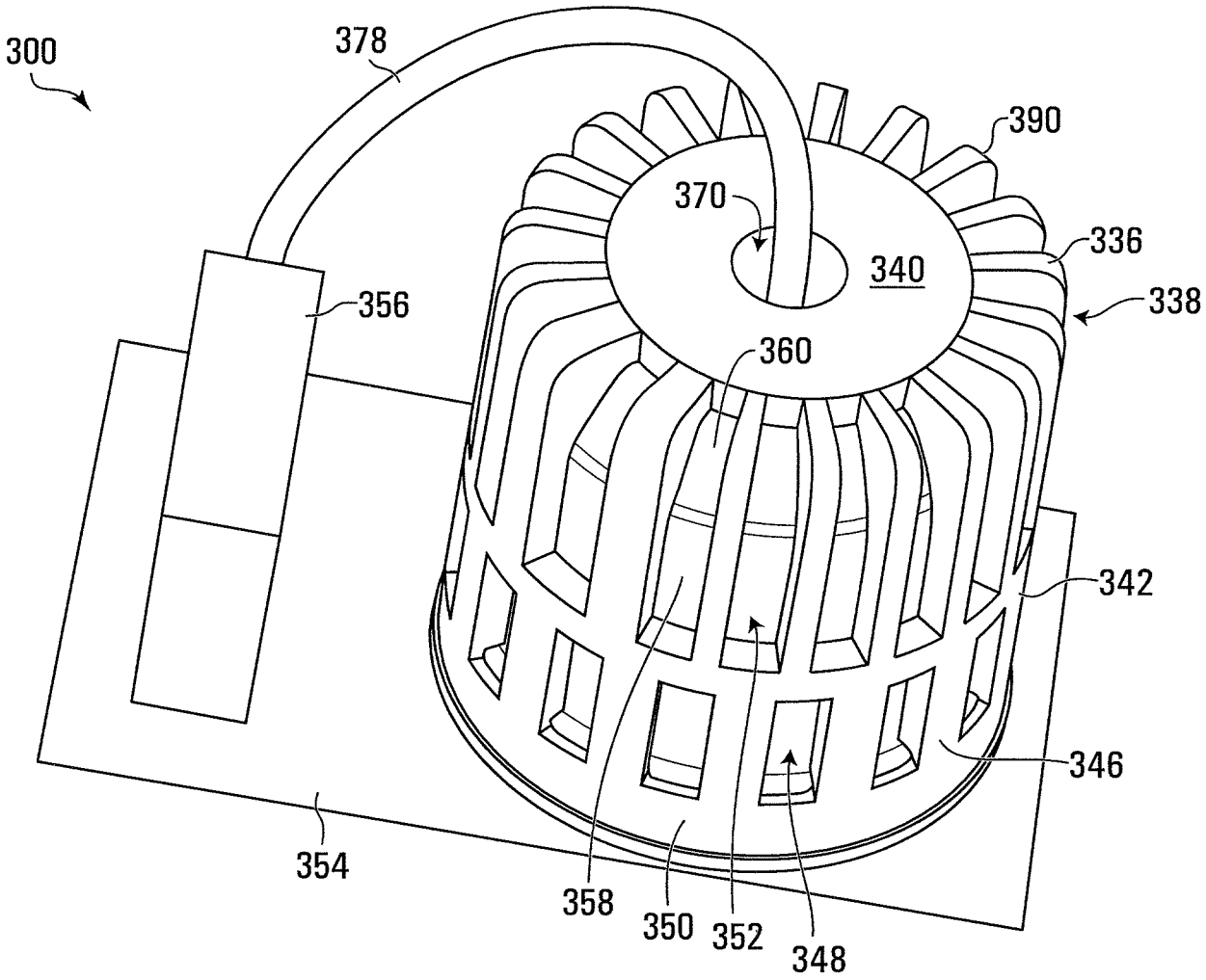
FIG. 10 is a top perspective view of a downlight fixture in accordance with another embodiment.

Turning to FIG. 10, in another embodiment, a downlight fixture 300 has a firestop element 390 surrounding the light can 352 of the fixture and resting on the fixture's rectangular base 354. The firestop element 390 may be configured to have an inner periphery spaced at a short stand off from the outer periphery of both the end cap 360 and cylindrical body 358 of the light can 352. Element 390 has a plurality of upper axially extending ribs 336 running from a disk-shaped top 340 of the element to a medial side wall band 342. The ribs 336 are defined by axially elongated radial through slots 338. A plurality of lower, shorter, axially extending ribs 346 between axially elongated radially opening slots 348 run between the medial side wall band 342 and a basal side wall band 350 of the element. The element 390 may taper from it basal side wall band 350 at a small angle of between two and ten degrees.

Firestop element 390 is provided with a central opening 370 in its top disk-shaped portion 360 which accommodates a conductor 378 extending from the ballast or wiring box 356 into the light can.

The downlight fixture 300 does not have a firestop element within the light can 352.

In use, the slots 338, 348 in the firestop element 390 assist in the dissipation of heat generated by the light. If due to a fire the temperature of the firestop element 390 exceeds the SET, the element expands to evelop the light can and char is formed to provide a thermal barrier. The basal band 350 of the element 390 is sized so that it will expand to close off any gap between base 354 and light can 352. As with element 190 (FIG. 4), the surface area of element 390 is increased by the provision of the spaced ribs 336, 346 and so the speed of intumescence is increased as compared with that of a solid element.

Element 390 may soften as its temperature increases beyond the normal operating temperatures of fixture 300 but remains below SET. However, in this instance, the firestop element may slump inwardly to be supported by the light can. If the element 390 is tapered, this will help ensure that the element will collapse toward the light can when it softens, and will char around the can. Moreover, the medial and basal bands 342, 350 of the element impart strength to the element which assists in keeping the ribs in place while they soften.

Figure 11:
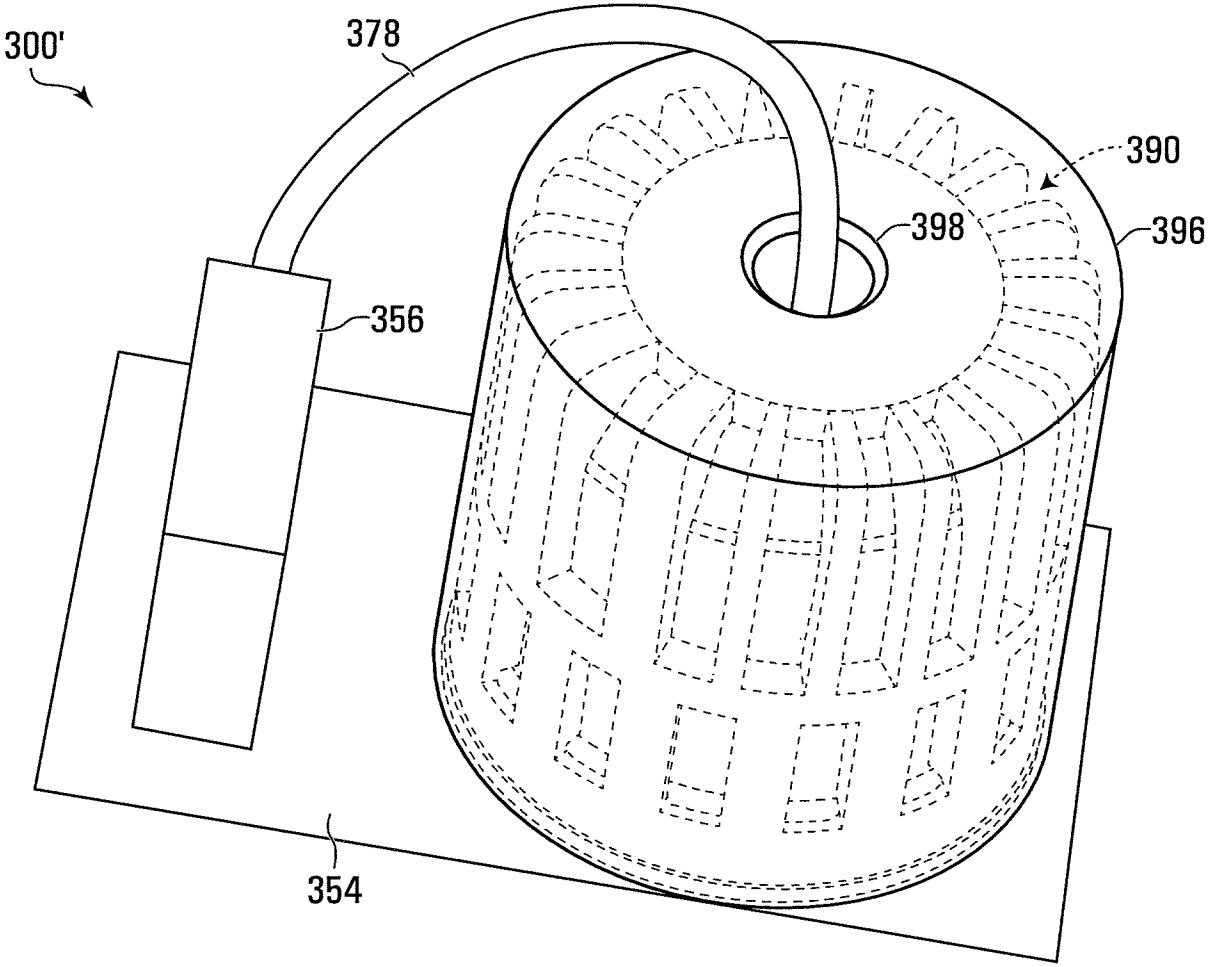
FIG. 11 is a top perspective view of a downlight fixture in accordance with another embodiment.

Turning to FIG. 11, modified downlight fixture 300' is the same as downlight fixture 300 except that fixture 300' has an external can 396 surrounding firestop element 390 with a top opening 398 to accommodate conductor 378. The external can 396 may be fabricated of metal, such as steel or aluminum, and may extend in close proximity to the outer periphery of firestop element 390. In the event of fire, the external can confines the expansion of the firestop element 390 and so assists in densifying the char resulting from intumescence of the firestop element.

Figure 12A:
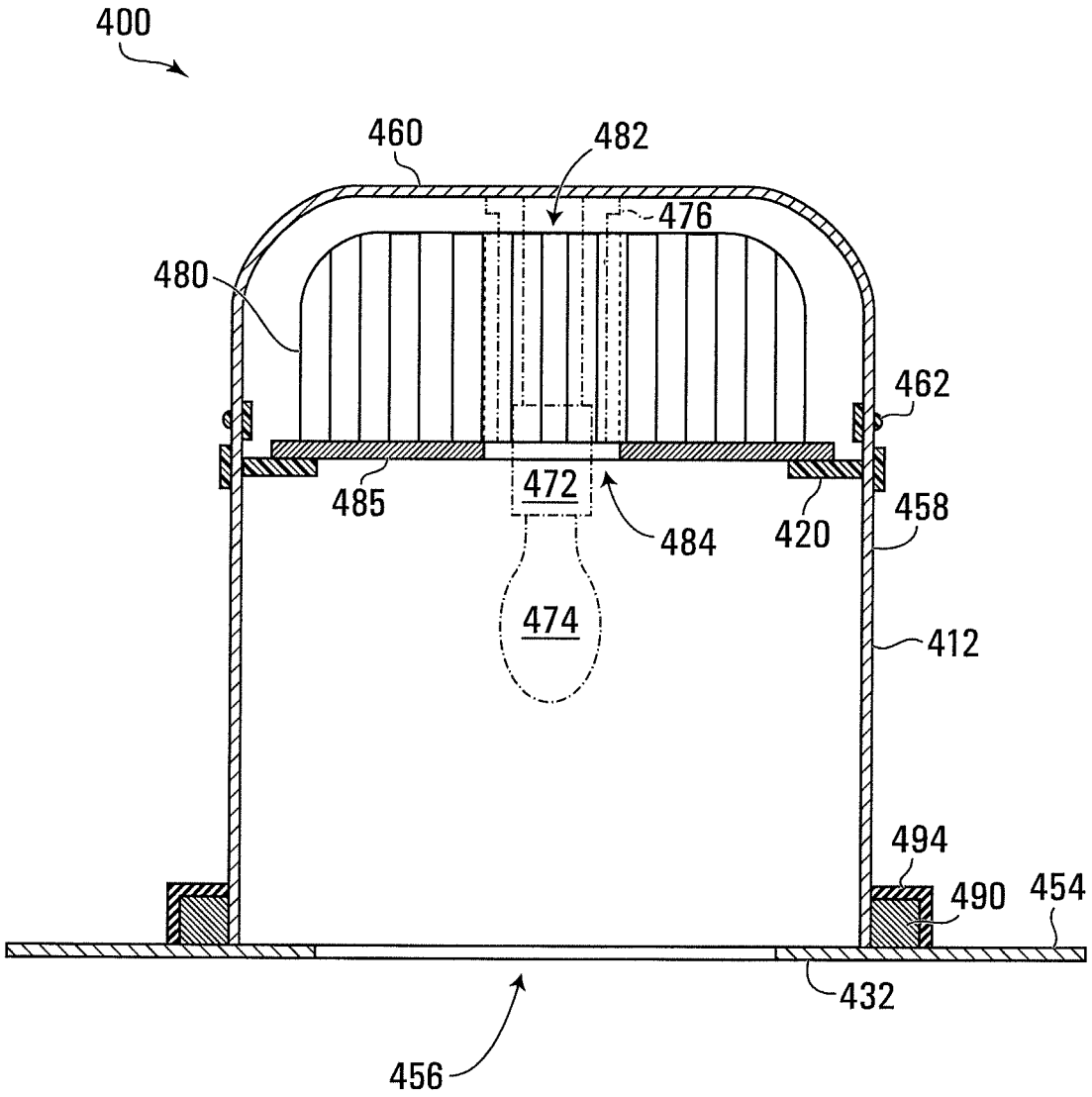
FIG. 12A is a schematic cross-sectional view of a downlight fixture in accordance with another embodiment.
Figure 13:
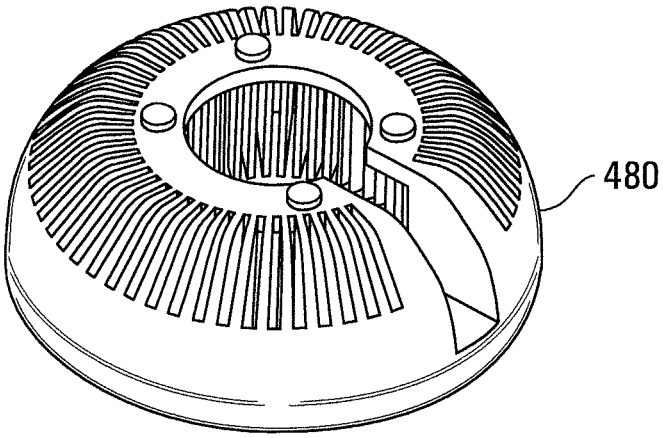
FIG. 13 is a top perspective view of the firestop element of FIG. 12A.

Turning to FIG. 12A, downlight fixture 400 has a light can 412 joined to a base 454. The base 454, being metal, is fire resistant. The light can 412 has a body 458 shaped as a cylindrical sleeve and an end cap 460 which is joined to the body by rivets 462. An opening 456 through the base 454 below the light can is bounded by a lip 432 which extends inwardly of the basal periphery of the light can 412 and acts as a non-flammable support, as will become apparent. A firestop element 480, shown in perspective view in FIG. 13, is mounted to a metal support plate 485. The firestop element 480 has a central opening 482 and the support plate 485 has an aligned central opening 484. Fire sensitive supports, namely meltable or flammable T-shaped tabs 420 have tongues inserted through slots in the body 458 of the light can 412 or, in another embodiment, the tongues are screwed into openings in the side wall of the light can so that these tongues project inwardly from the light can. The support plate 485, and therefore firestop element 480, rests on the tongues of the tabs 420. The tabs are fabricated of a material which melts or burns off in a fire, such as a plastic, as, for example, nylon or another thermoplastic.

A light mount (socket) 472 is disposed within openings 482, 484 and mounted by mounts 476 that extend through the firestop element opening 482 and attach to the light can 412. An electrical conductor (not shown) extends from a wiring box or ballast (not shown) through opening 482 to the light mount. A light bulb 474 is mounted to the light mount. Notably, openings 482, 284 have a diameter greater than that that of both the light mount 472 and the light bulb 474. A firestop gasket ring 490 extends about the base of the light can 412 and is enveloped by a metal sleeve 494.

In manufacture, the firestop element 480 with support plate 485 is set onto the tongues of the plastic tabs 420 projecting from the body 458 of the light can. The end cap 460 with supported light mount 472 is then mounted to the light can body 458 using rivets 462. Typically a light bulb may be mounted to the socket after installation in a ceiling.

Figure 12B:
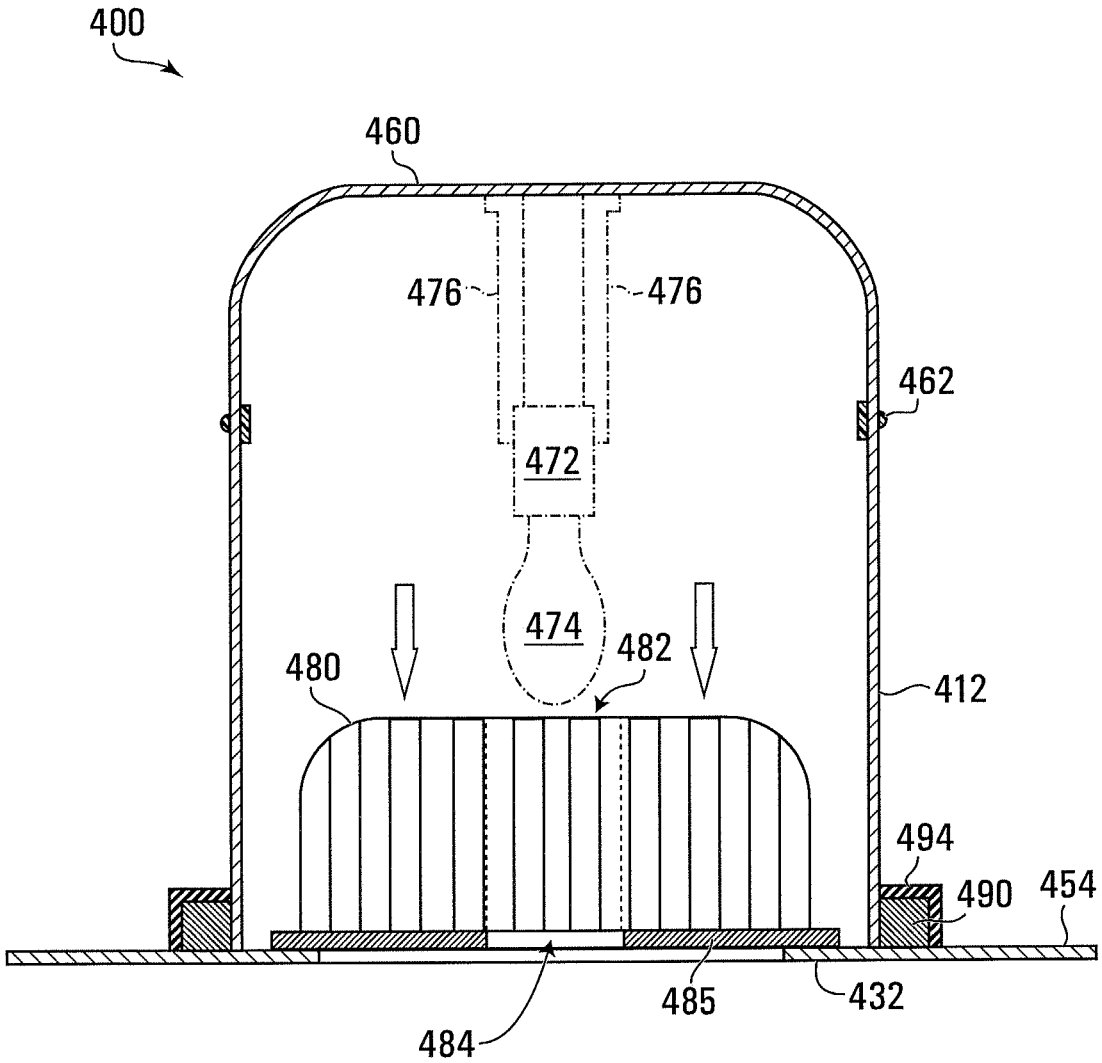
FIG. 12B is a schematic cross-sectional view of the downlight fixture of FIG. 12A showing a firestop element in a deployed position.

In use, in the event of a fire, the meltable or flammable tabs 420 melt and/or burn off. In consequence, firestop element 480 with its support plate 485 are no longer supported and they drop downwardly until, as illustrated in FIG. 12B, the periphery of the support plate 485 stops against the lip 432 of the base 454 of the fixture 400. Thus, the lip 432 of the base acts as a limiter, limiting the drop of the firestop element and its support plate. Because the diameter of central openings 482, 484 of the firestop element 480 and support plate 485 exceed the diameter of the light base 472 and light 474, and because the light base is mounted by mounts 476 extending through opening 482, the element 480 and plate 485 are free to fall to past the light socket and light bulb once the tabs melt or burn off. With the firestop element now at the base of the light can, as this element intumesces it expands to plug the can at the bottom. The support plate 485 helps hold the intumesced firestop element and resulting char in place to block the opening. Thus, the intumesced firestop element blocks flames from entering the light can and possibly extending through any openings in the can. It also reduces the heat inside the can.

Further, the intumescent gasket ring 490 extending about the light can intumesces. The metal sleeve 494 constrains the ring such that the only place it can expand while it intumesces is into the interface between the light can 412 and base 454. The constraining sleeve 494 also densifies the char such that the interface between the light can and base is not only plugged, but there is a strong thermal barrier at this interface.

Figure 14A:
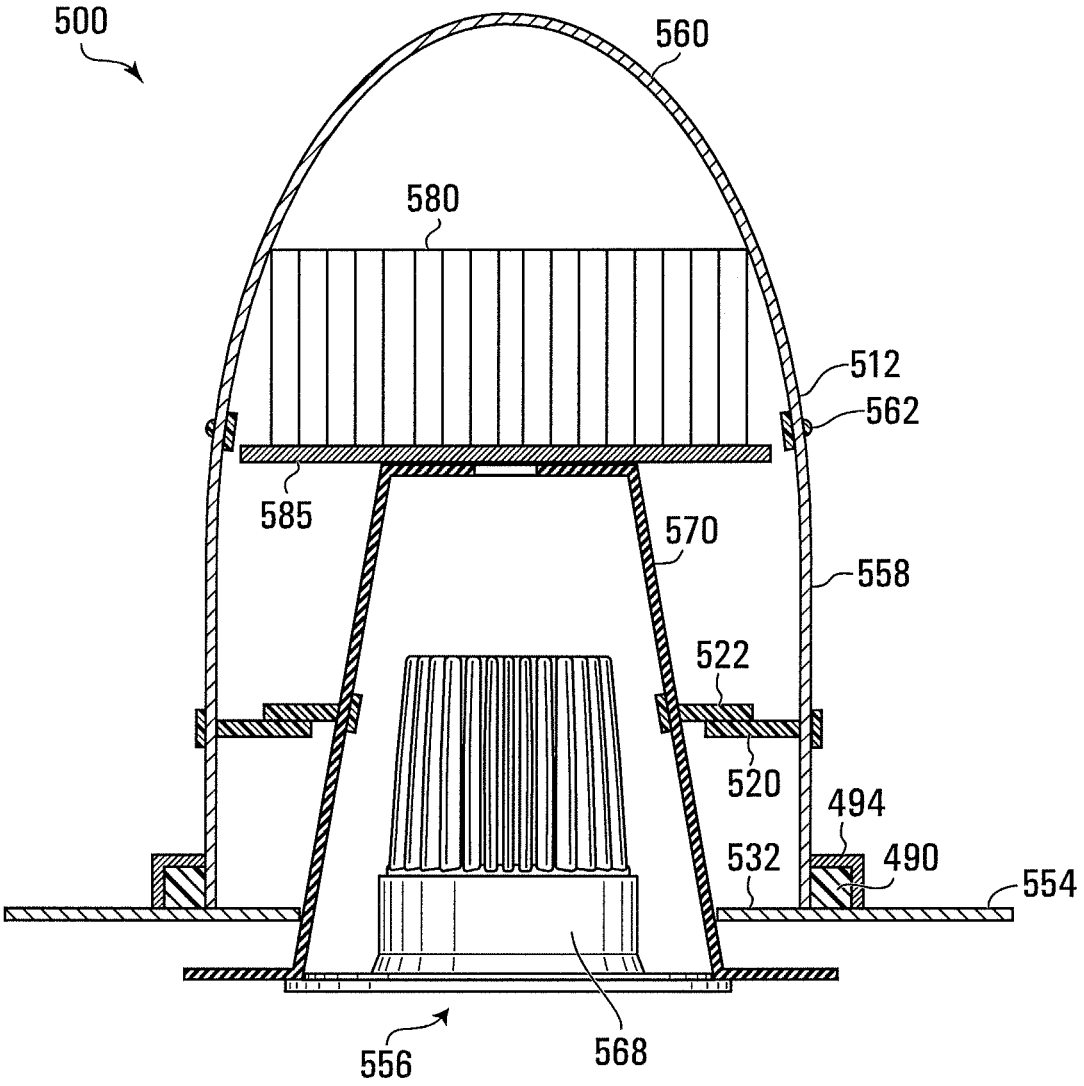
FIG. 14A is a schematic cross-sectional view of a downlight fixture in accordance with another embodiment.
Figure 15:
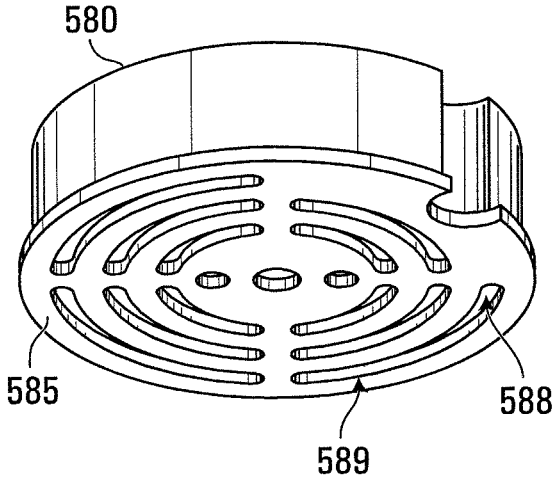
FIG. 15 is a bottom perspective view of the firestop element and support plate of FIG. 14A.

Turning to FIG. 14A, LED downlight fixture 500 has a light can 512 mounted on base 554. The light can 512 has a body 558 shaped as a cylindrical sleeve and an end cap 560 which is joined to the body by rivets 562. An opening 556 through the base 554 below the light can is bounded by a lip 532 which extends inwardly of the basal periphery of the light can 512. Plastic T-shaped tabs 520 supported by the light can 512 have tongues projecting inwardly from the light can. Plastic T-shaped tabs 522 supported by a heat sink 570 have tongues projecting outwardly from the heat sink. The tabs 522 of the heat sink rest on the tabs 520 of the light can such that the heat sink 570 is supported within the light can 512. An LED light 568 is mounted within heat sink 570 by any suitable means. A firestop element 580 is mounted to a metal support plate 585 and the metal support plate rests on the top of the heat sink 570. The firestop element 580 and support plate 585 are shown in perspective view in FIG. 15 from which it will be apparent that the firestop element has a series of disk voids 588 and the plate has a series of plate voids 589 aligned with the disk voids. Further, element 580 and the plate 585 have aligned slots 590, 591 to accommodate a conductor that feeds to the LED light.

An intumescent ring 490 and constraining metal sleeve 494 surround the base of the light can as described in conjunction with FIGS. 12A and 12B.

In manufacture, the tabs 520 are inserted into the body 558 of the light can 512 and the heat sink is then moved into place within the body 558. Tabs 522 are then inserted into the heat sink so that the tongues of tabs 522 overlie the tongues of tabs 520 whereby the heat sink is supported within body 558 of the light can 512. Next the firestop element 580 with its support plate 585 is set in place on the top of the heat sink and the cap 560 of the light can is riveted to the light can body 558.

Figure 14B:
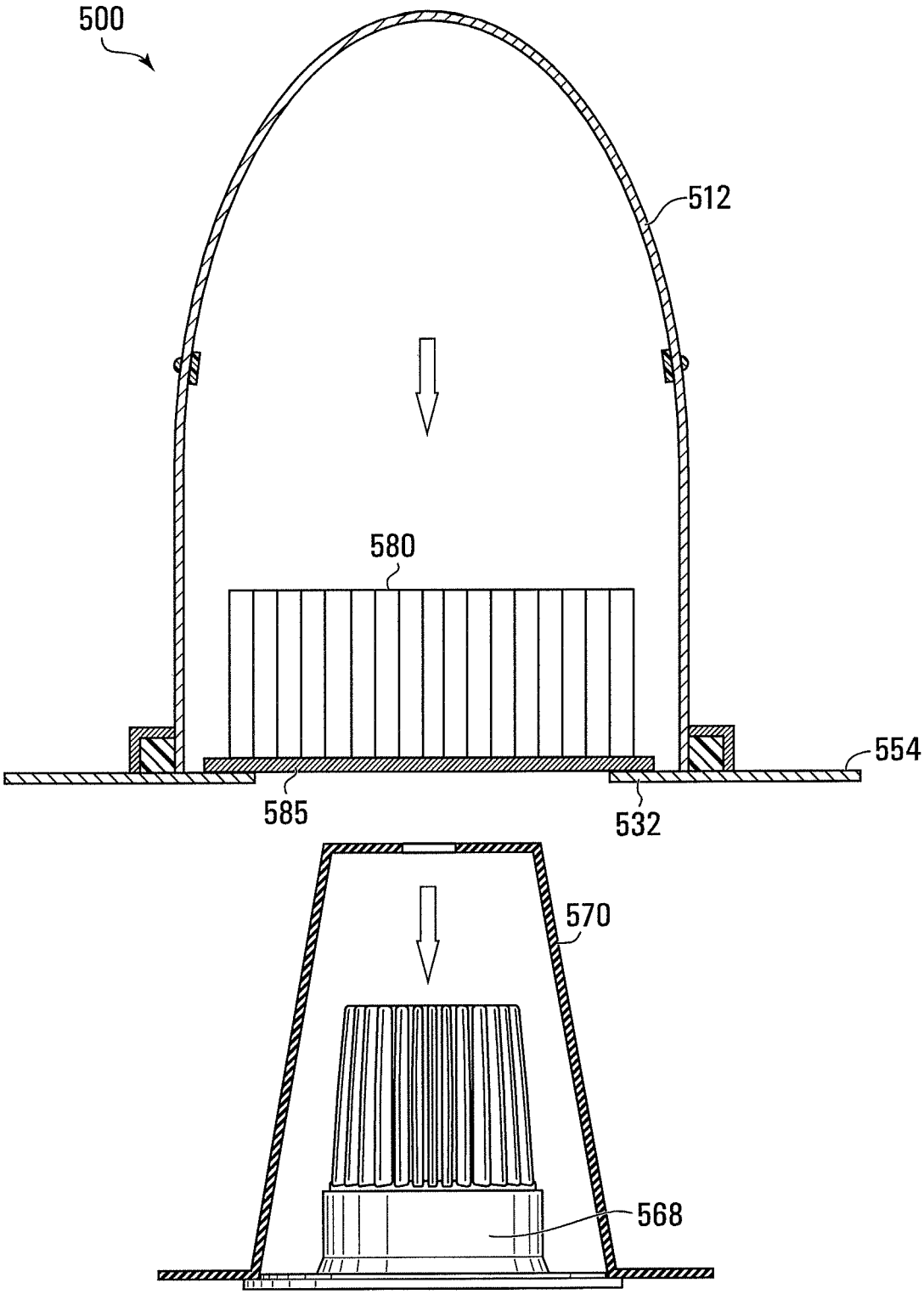
FIG. 14B is a schematic cross-sectional view of the downlight fixture of FIG. 13A showing a firestop element in a deployed position.

In use, in the event of a fire, plastic tabs 520 and 522 melt or burn off. In consequence, heat sink 570 with its LED light 568 is no longer supported within the light can 512 and it falls away, as illustrated in FIG. 14B. Since the firestop element 580 with its support plate 585 had rested upon the heat sink, it falls with the heat sink until its fall is arrested when the periphery of the support plate 585 hits the lip 532 of the base 554 of the fixture, as is also illustrated in FIG. 14B. Thus, the lip 532 of the base 554 of the fixture acts as a limiter, limiting the fall of the firestop element and its support plate. With the firestop element now at the base of the light can, as this element intumesces, it expands to plug the can at the bottom. This blocks flames from entering the light can and possibly extending through any openings in the can; it also reduces the heat inside the can. With the voids 589 in the plate 585 aligned with the voids 588 in the disk, the disk is exposed more rapidly to a heat build up, speeding its intumescing reaction time.

If the heat sink makes a close fit with the light can, lip 532 could be replaced with spring tabs joined to base 554. These tabs would be deflected upwardly by the heat sink when it is in place within the light can and would resiliently spring to a deployed, inwardly projecting, position when the heat sink fell away in the event of a fire such that the firestop element 580 and its support plate 585 would be arrested by the deployed hinge tabs.

Figure 16A:
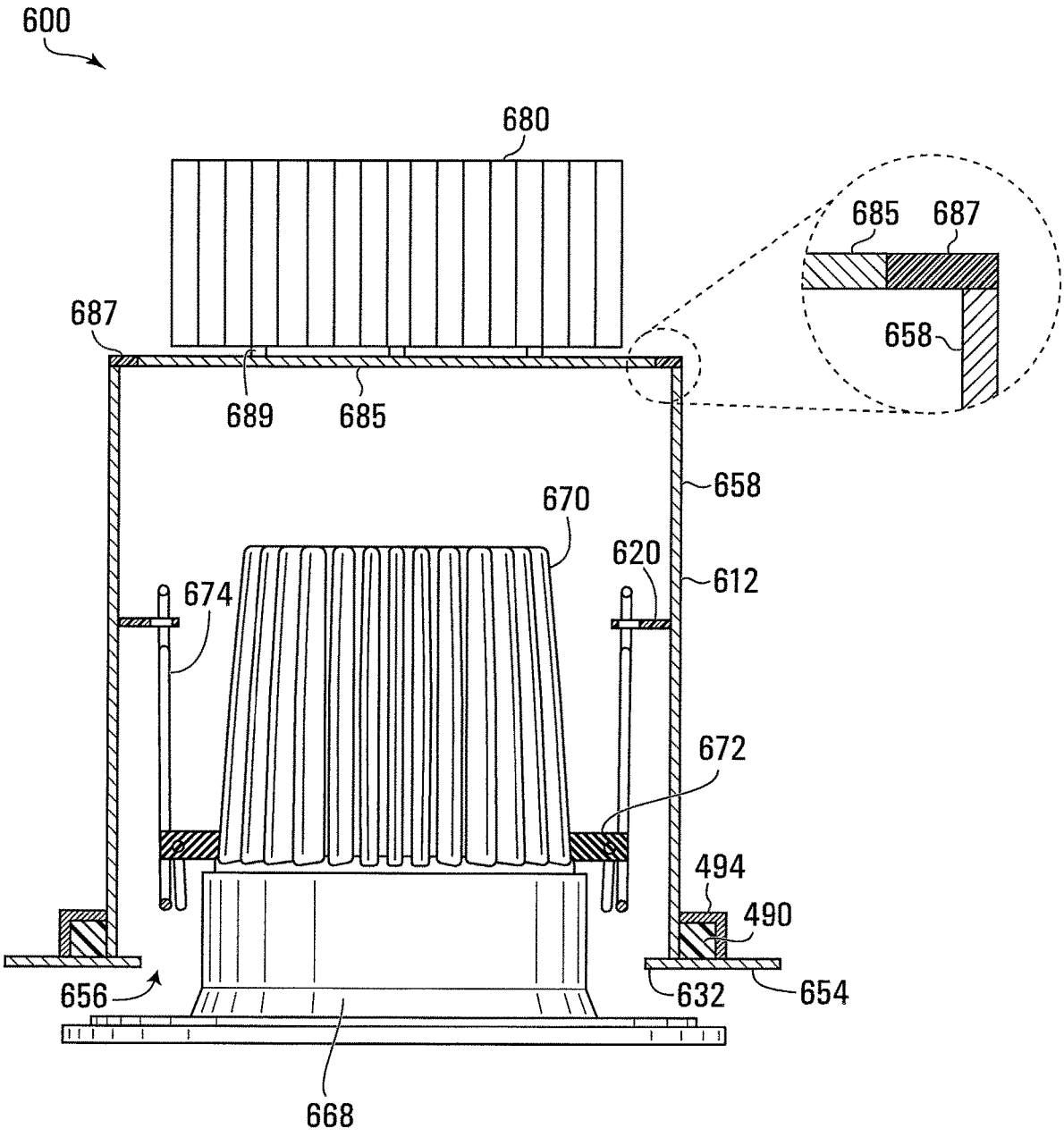
FIG. 16A is a schematic cross-sectional view of a downlight fixture in accordance with another embodiment.
Figure 16B:
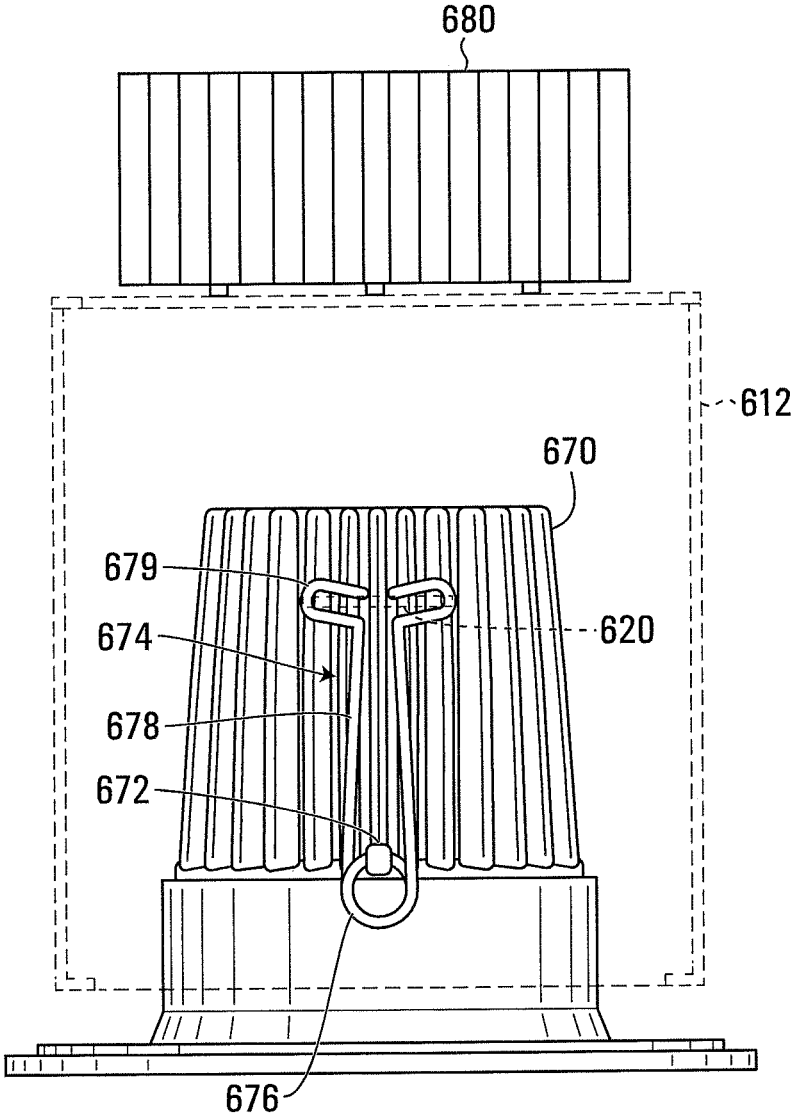
FIG. 16B is a simplified side view of the downlight fixture of FIG. 16A.

Referencing FIGS. 16A and 16B, in a further embodiment, downlight fixture 600 has a light can 612 mounted on base 654. An opening 656 below the light can through the base 654 is bounded by a lip 632 which extends inwardly of the basal periphery of the light can 612. Fire sensitive supports, namely meltable or flammable C-clips 620 are joined to, and project inwardly from, light can 612. A heat sink 670 is an integral part of LED light 668, the light 668 has a pair of ears 672. A spring clip 674 is mounted to each ear 672. Each spring clip 674 has a medial spring section 676 from which two legs 678 extend; the legs terminate in feet 679.

To install the heat sink in the light can, the two legs of a spring clip are pinched together against the urging of spring section 676, inserted into a C-clip, and released. This is repeated with the second C-clip. The feet 679 of the legs allow the LED light to hang from the C-clips, as shown in FIGS. 16A and 16B. The LED light may then be pressed upwardly into the light can until the lip 671 of the LED light abuts base 654.

Figure 17:
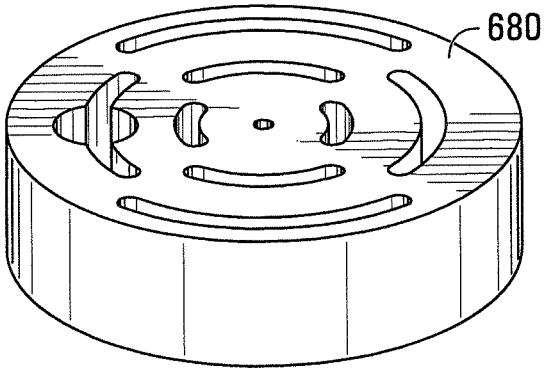
FIG. 17 is a top perspective view of the firestop element of FIG. 16A.

The top of the light can 612 is a steel plate 685 surrounded by a fire sensitive support, namely meltable or flammable ring 687, which may be a thermoplastic ring. The ring sits atop the light can body 658. The ring 687 can be held to the light can body 658 by rivets or screws and can be press fit to the steel plate. The plate may be solid, or if helpful for heat dissipation, apertured. A firestop element 680, illustrated in perspective view in FIG. 17, is mounted to the steel plate by stand-off nibs 689. The stand-off nibs assist in heat dissipation.

An intumescent ring 490 and constraining metal sleeve 494 surround the base of the light can as described in conjunction with FIGS. 12A and 12B.

Figure 16C:
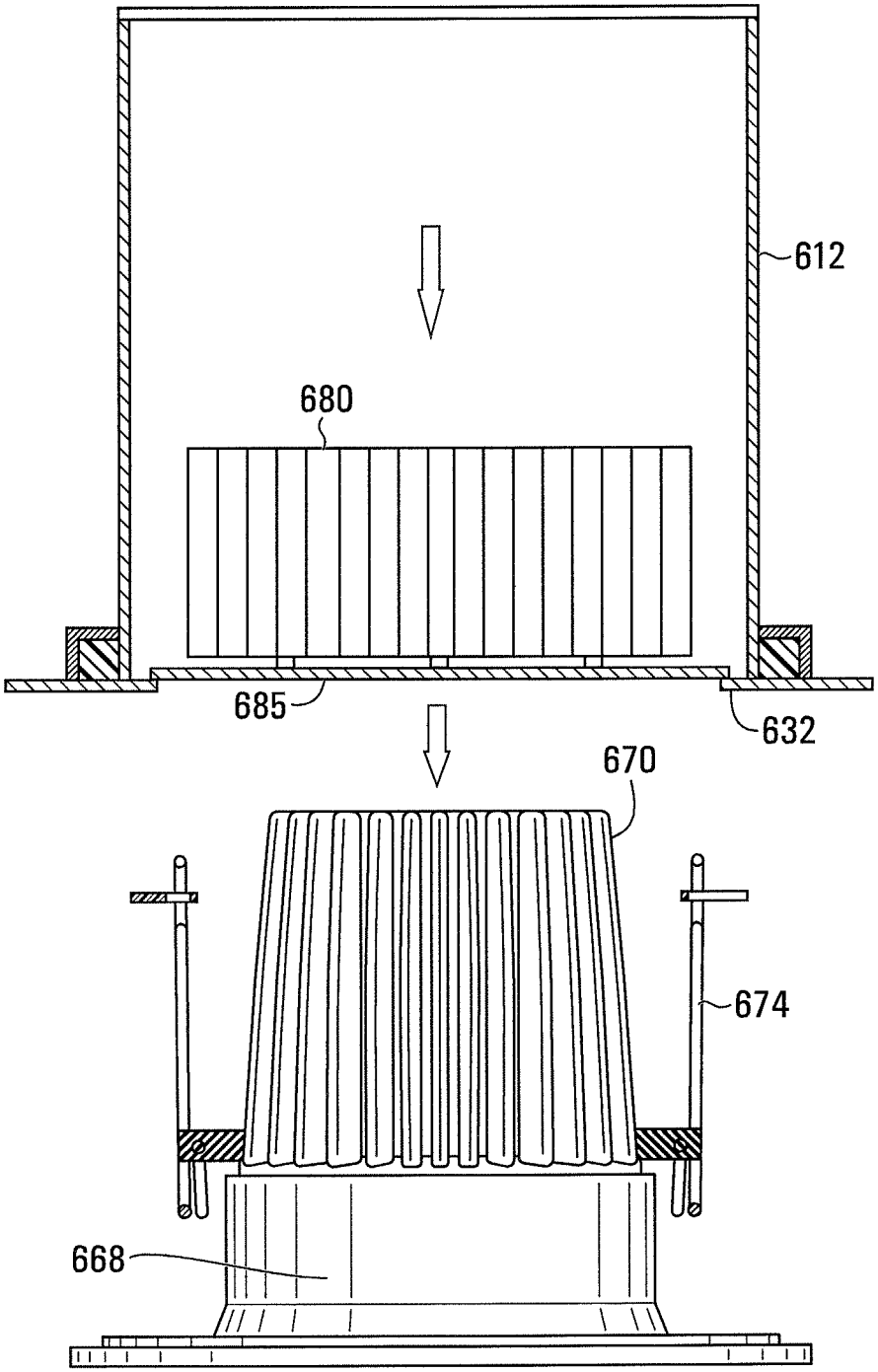
FIG. 16C is a schematic cross-sectional view of the downlight fixture of FIG. 16A showing a firestop element in a deployed position.

In use, in the event of a fire, meltable or flammable C-clips 620 melt and/or burn off. In consequence, LED light 668 with its spring clips 674 is no longer supported within the light can 612 and it falls away, as illustrated in FIG. 16C. Additionally, meltable or flammable ring 687 burns off. This removes the support for firestop element 680 and plate 685. Thus the firestop element and plate 685 fall with the LED light until they are arrested when the periphery of the support plate 685 hits the lip 632 of the base 654 of the fixture, as is also illustrated in FIG. 16C. With the firestop element now at the base of the light can, as this element intumesces it expands to plug the can at the bottom. This blocks flames from entering the light can and possibly extending through any openings in the can; it also reduces the heat inside the can.

The meltable or flammable C-clips may be made of nylon and the spring clips 674 may be made of spring steel. A consequence of this is that the spring clips 674 may slip within the C-clips 620 due to the relatively low coefficient of static friction between nylon and steel, specifically about 0.1. If there is slippage, the LED light 668 will migrate down toward the position shown in FIGS. 16A and 16B thereby reducing the aesthetic appeal of the light fixtures and possibly presenting a catching hazard.

Figure 16D:
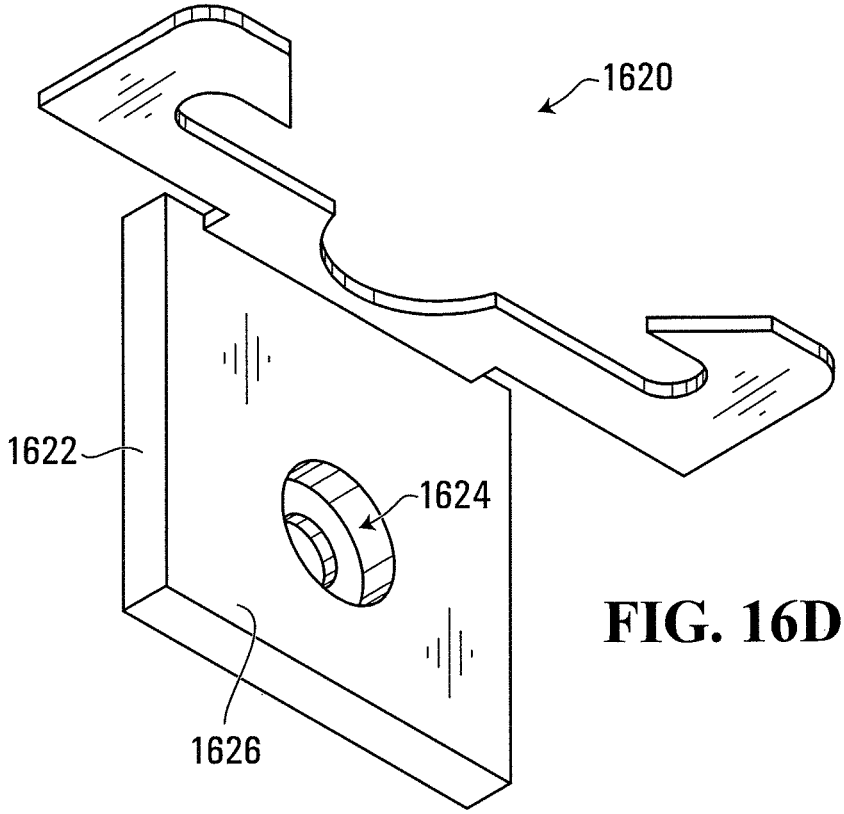
FIG. 16D is a front perspective view of a clip in accordance with another embodiment.
Figure 16E:
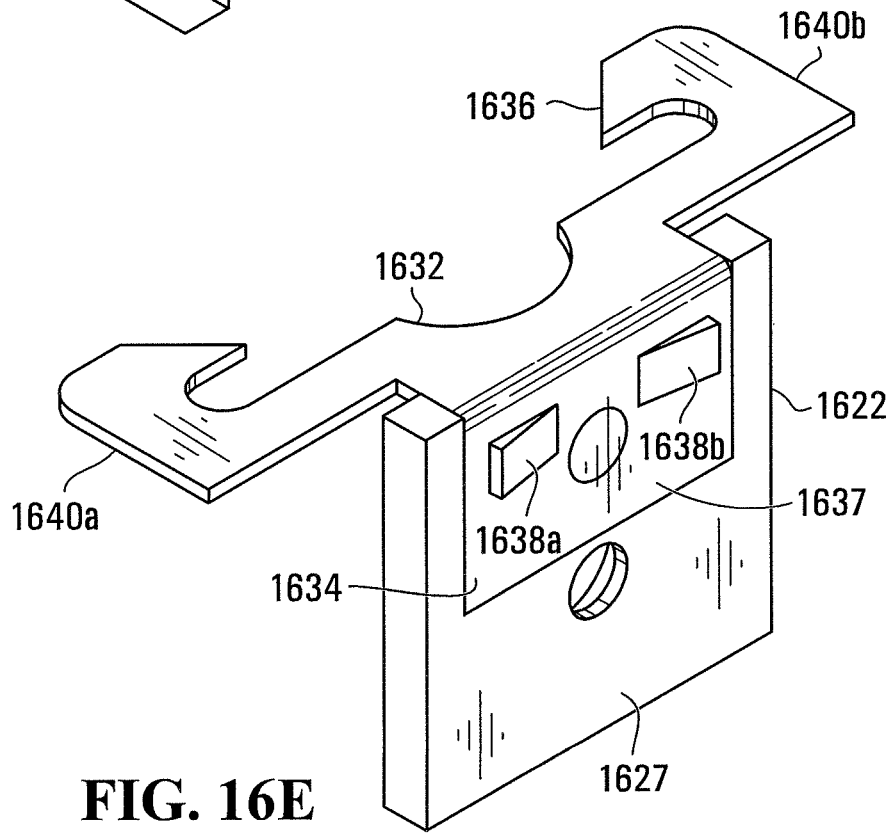
FIG. 16E is a rear perspective view of the clip of FIG. 16D.
Figure 16F:
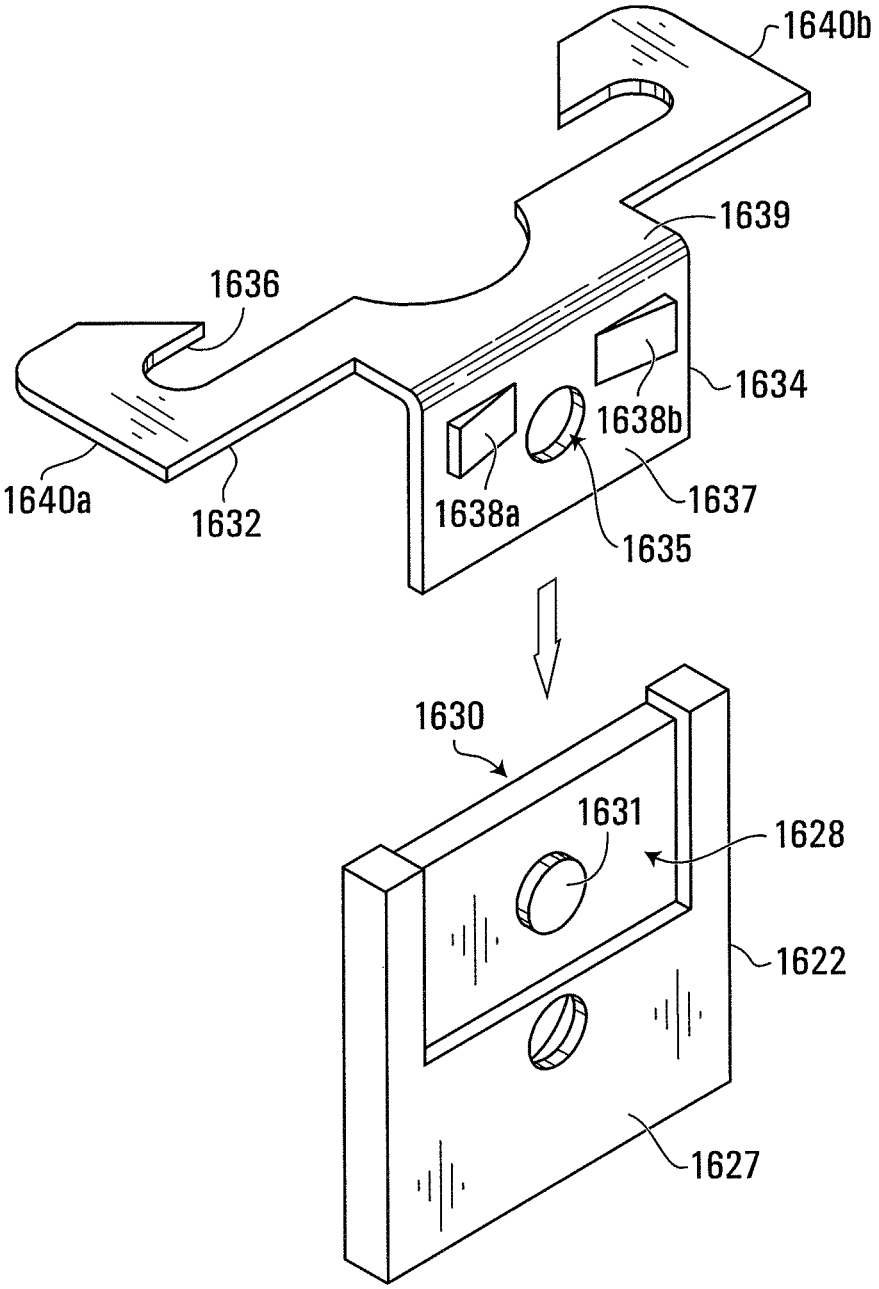
FIG. 16F is an exploded view of the clip of FIG. 16D.
Figure 16G:
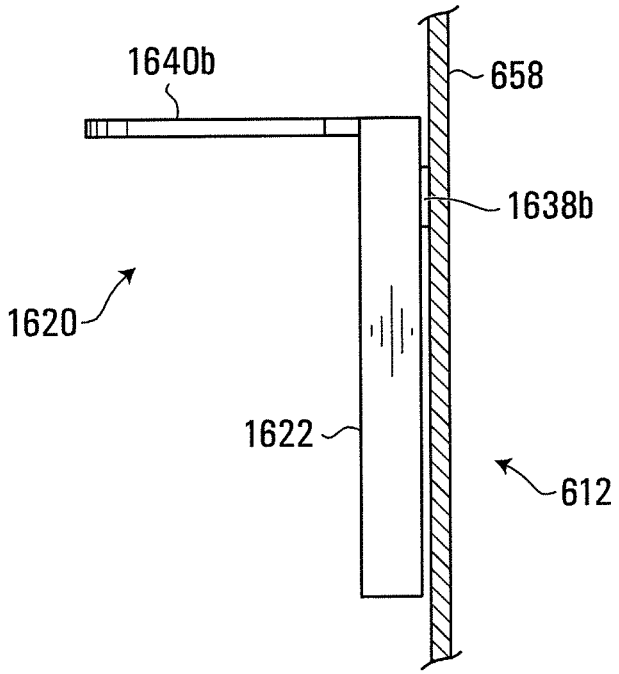
FIG. 16G is a fragmentary assembly side view of the clip of FIG. 16D in a light can.

To address the prospect of the LED light 668 slipping down from the light can, each C-clip 620 may be replaced by a different fire sensitive support, namely the clip shown in FIGS. 16D to 16G. Turning to FIGS. 16D to 16F, clip 1620 has a base 1622 which is fabricated of a meltable or flammable material, such as nylon. Base 1622 has a shouldered through hole 1624 with the larger diameter section of the hole extending from the front face 1626 of the base. The rear face 1627 of the base has a rectangular depression 1628 which meets a rectangular depression 1630 in the top of the base. A boss 1631 located within rectangular depression 1628 projects from the rear face of the base. The clip 1620 also has a supporting element 1632 fabricated of a metal such as steel. The supporting element has an L-shaped mounting section 1634 and a clipping end 1636. The mounting section has a lower wall 1637 and an upper wall 1639. Lower wall 1637 has opposed rearward projections, namely ramps 1638*a*, 1638*b*, and a circular through hole 1635. The clipping end 1636 has a pair of opposed arms 1640*a*, 1640*b* that form a C-shape. The lower 1637 and upper 1639 walls of the mounting section are sized to fit into the rectangular depressions 1628 and 1630, respectively, of the base 1622 and the through hole 1635 is sized to receive the boss 1631 of the base.

The mounting section 1634 of the supporting element 1632 can be supported by the base as shown in FIG. 16E with the boss 1631 and depressions 1628 and 1630 of the base locating the supporting element on the base. With the mounting element supported by the base, the clip 1620 may be joined to the light can. More specifically, referring to FIG. 16G, the clip may be positioned within light can body 658 with the rear wall of both the base and mounting section against the wall of the light can body such that the lower wall 1637 of the mounting section is sandwiched between the light can body and the base 1622. A fastener (not shown) is then inserted through the shouldered hole 1626 to attach the clip to the light can. For example, a rivet may be shot into the shouldered hole 1626 of the base and through the light can body. This jams the ramps 1638*a*, 1638*b* against the light body wall and holds the clip 1620 against rotation about the rivet.

With two clips 1620 installed in a light can, spring clips 674 (FIG. 16A) extending from an LED light 668 (FIG. 16A) may be attached to the clips 1620 as aforedescribed in connection with C-clips 620 (FIG. 16A) and the heat sink pushed upwardly into the light can until the lip 671 (FIG. 16A) of the heat sink abuts the base 654 (FIG. 16A) of the light can 612 (FIG. 16A). With clips 1620, the supporting element 1632 can be fabricated of steel such that, with the spring clips 674 also fabricated of steel, a steel-to-steel interface is provided. The static coefficient of friction for such an interface is about 0.70. This is much higher than the about 0.1 static coefficient of friction at an interface between nylon and steel connection that may result with use of clips 620. Thus, clips 1620 greatly reduce the likelihood of LED light 668 slipping down in light can 612.

In a fire, the nylon base 1622 of clip 1620 melts away so that the LED light 668 with its spring clips 674 (and its LED light) is no longer supported within the light can 612 and it falls away. If desired, the rivets holding the nylon base to the light can be made of aluminum so that they too melt away in a fire.

Figure 18A:
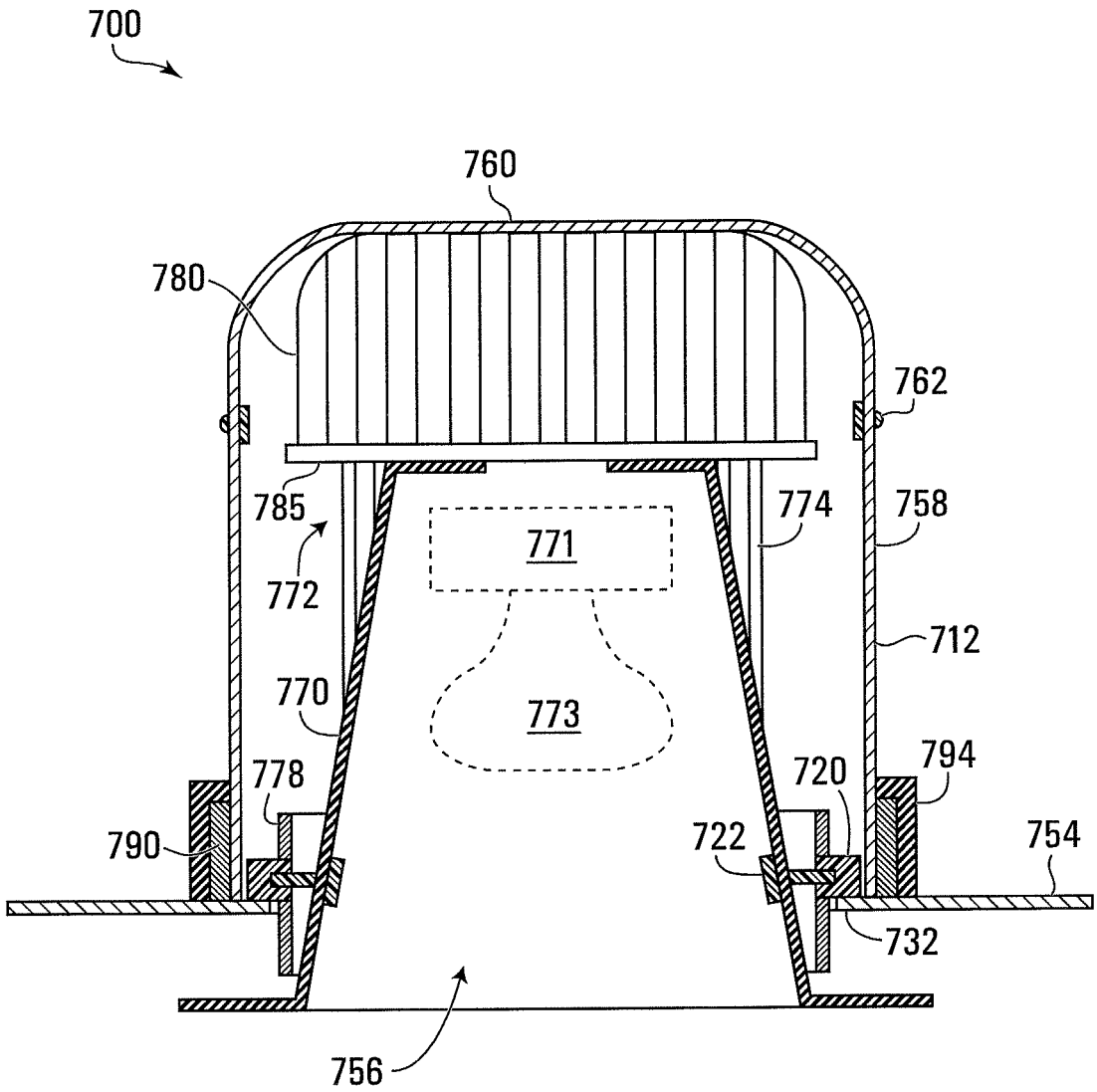
FIG. 18A is a schematic cross-sectional view of a downlight fixture in accordance with another embodiment.
Figure 19A:
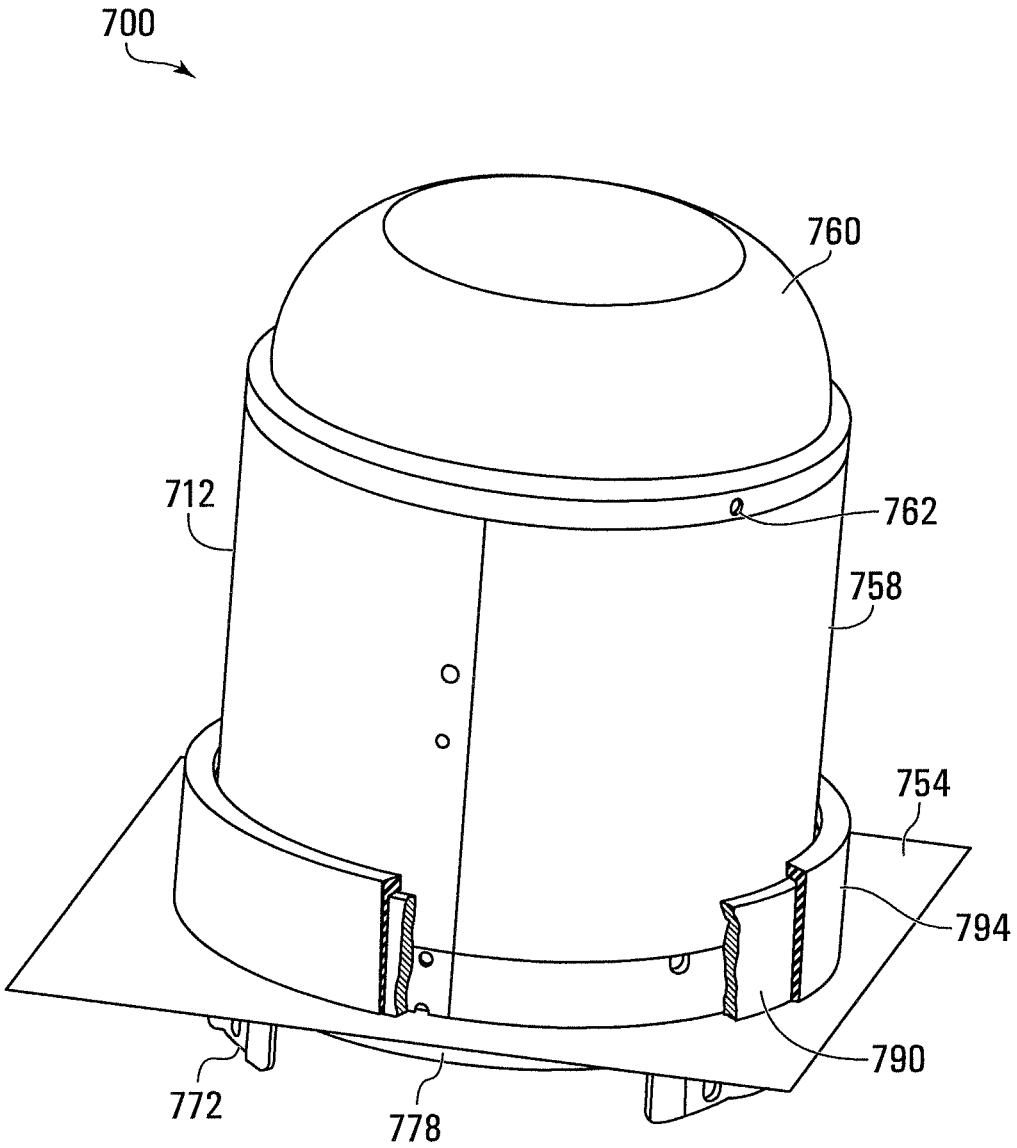
FIG. 19A is a partially cut away top perspective view of the downlight fixture of FIG. 18A.
Figure 19B:
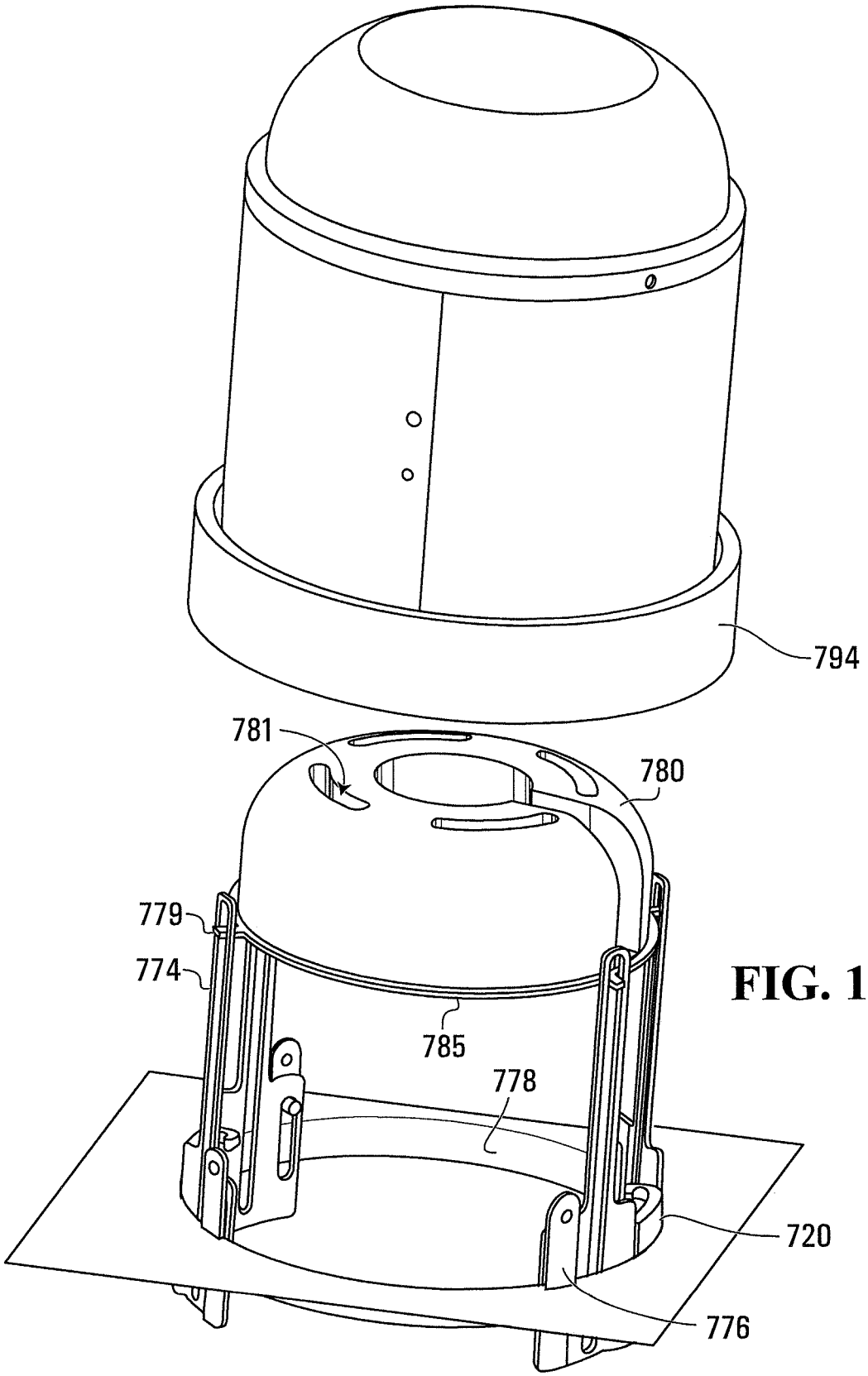
FIG. 19B is an exploded view of a portion of the downlight fixture of FIG. 19A.

In another embodiment, referring to FIGS. 18A, 19A, and 19B, LED downlight fixture 700 has a light can 712 mounted on base 754. The light can 712 has a body 758 shaped as a cylindrical sleeve and an end cap 760 which is joined to the body by rivets 762. An opening 756 through the base 754 below the light can is bounded by a lip 732 which extends inwardly of the basal periphery of the light can 712. A guiderail assembly 772 has vertical guiderails 774 and lugs 776 joined to a ring 778. The guiderail assembly 772 is supported on base 754 by the lugs, which overlie lip 732. Plastic clips 720 are supported by the guiderail assembly. A heat sink 770 (not shown in FIG. 16B) which contains a light base 771 and an LED light 773 (FIG. 18A) is supported within the light can 512 by plastic T-shaped tabs 722 mounted to the heat sink with tongues projecting outwardly from the heat sink 760 into clips 720. A firestop element 780 is mounted to a metal support plate 785 and the metal support plate rests on the top of the heat sink 770. The firestop element has a series of through slots 781 which increase its surface area. The metal support plate has projecting metal tabs 779, with one tab guided by each guiderail 774. In consequence, firestop element 780 and its support plate 785 are constrained to slide vertically within the light can 712.

A firestop gasket ring 790 extends about the base of the light can 752 and is supported on base 754. The firestop gasket ring 790 is enveloped by a metal sleeve 794.

In manufacture, the guiderail assembly 772 is mounted to the base 754 then the tabs 779 of metal support plate 785 are inserted into the guiderails 774 so that the firestop element 780 with its support plate 785 are slidably mounted to the guiderails. Next the heat sink 770 may be inserted into the body 758 of the light can 712 and tabs 722 inserted into the heat sink so that the tongues of the tabs 722 extend within the clips 720 whereby the heat sink is supported within body 758 of the light can 712 and the firestop element 780 with its support plate 785 rests on the top of the heat sink. Cap 760 of the light can is then riveted to the light can body 758.

Figure 18B:
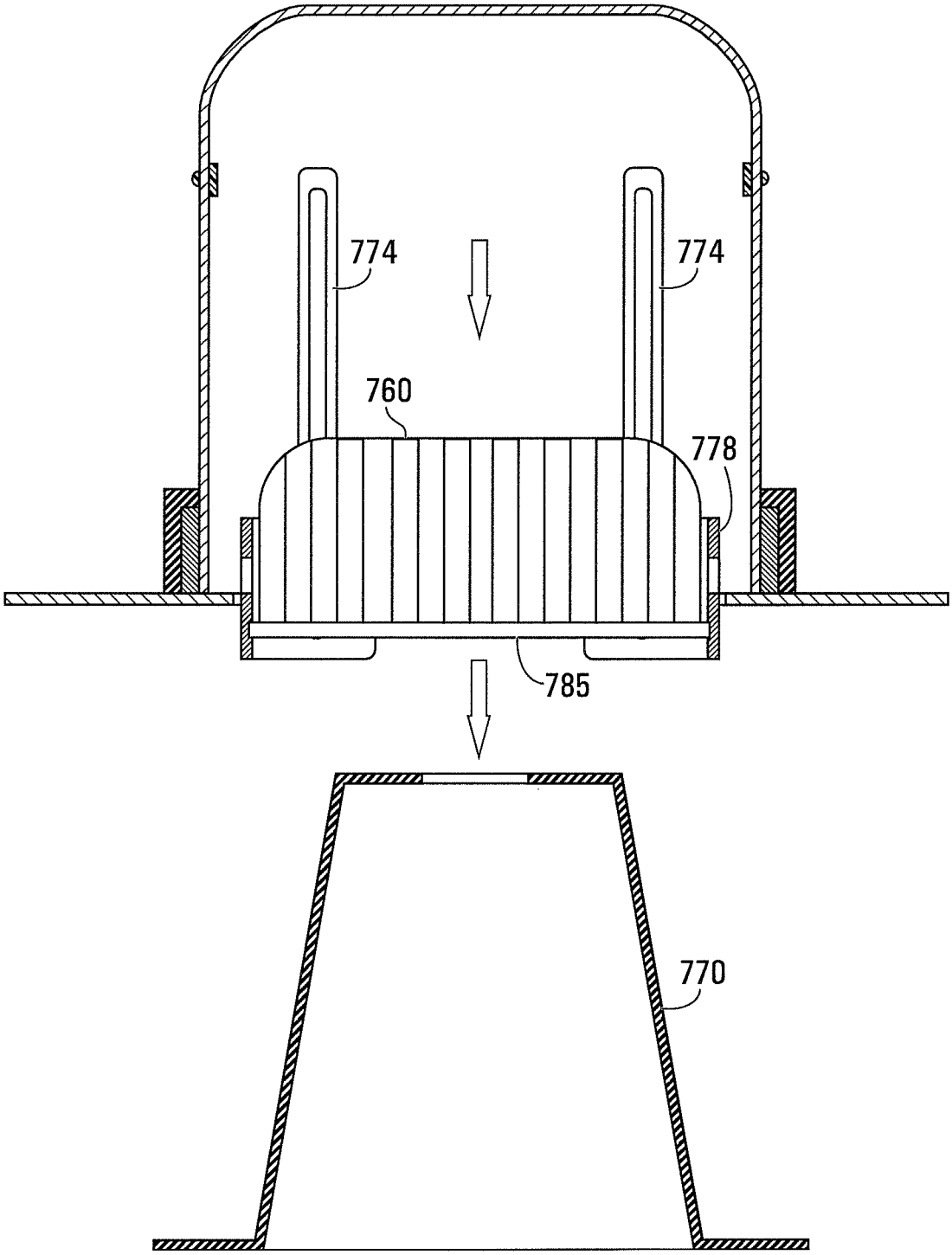
FIG. 18B is a schematic cross-sectional view of the downlight fixture of FIG. 18A showing a firestop element in a deployed position.
Figure 19C:
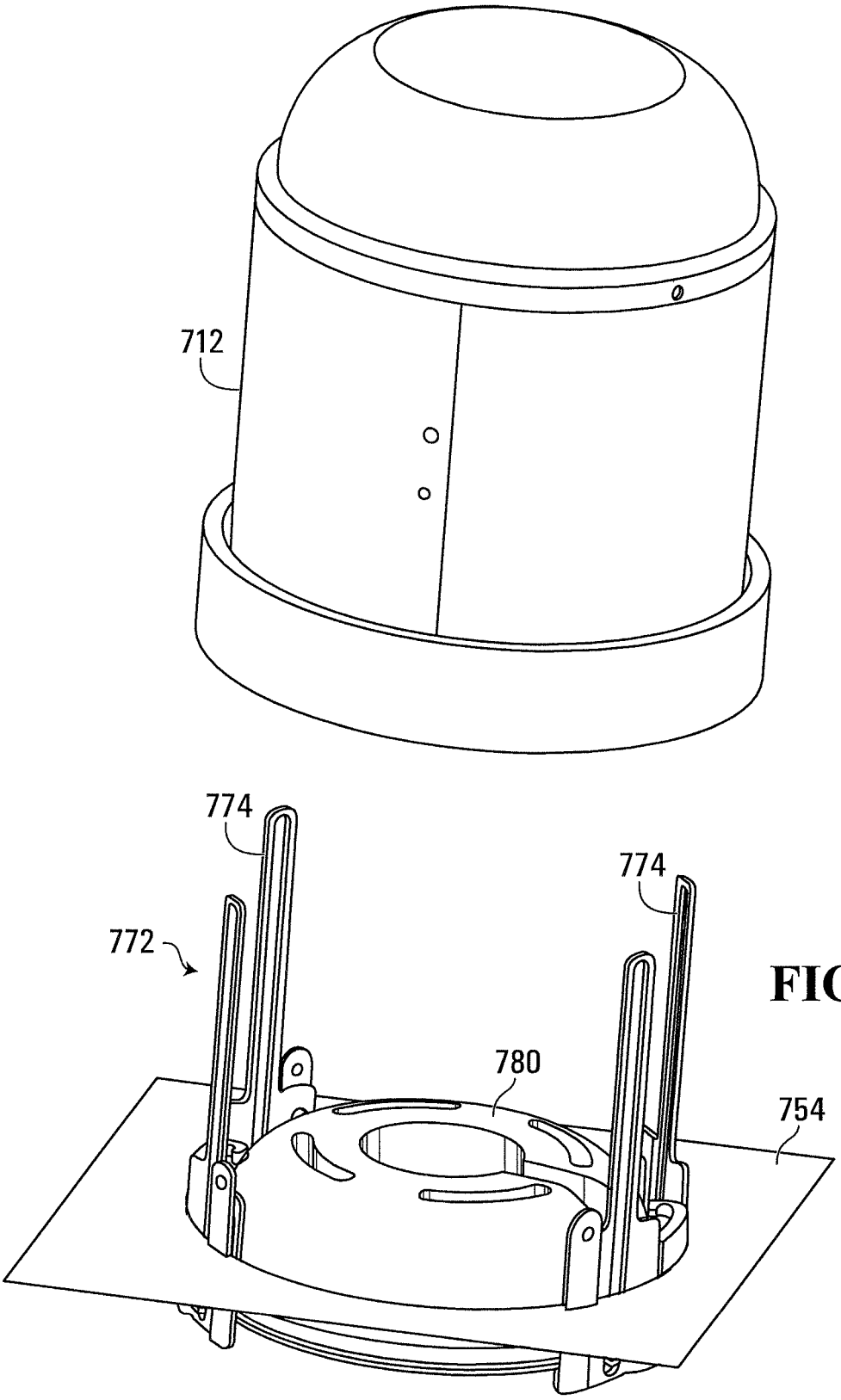
FIG. 19C is an exploded view of a portion of the downlight fixture of FIG. 19A showing a firestop element in a deployed position.

In use, in the event of a fire, clips 720 and tabs 722 melt or burn off. In consequence, heat sink 770 (with its light base and LED light) is no longer supported within the light can 712 and it falls away, as illustrated in FIG. 18B. Since the firestop element 780 with its support plate 785 had rested on the heat sink, they fall with the heat sink until they are arrested when the tabs 779 of the support plate 785 impact the fall limiting bottom of the guiderails 774, as is illustrated by FIGS. 18B and 19C. In this regard, the guiderails 774 constrain the firestop element and support plate to fall in a predictable vertical path as the tabs 779 of the support plate slide within the guiderails. This helps ensure that the firestop element and support plate fall completely to the bottom of the can and do not somehow jam within the light can and fail to fully deploy. With the firestop element now at the base of the light can, as this element intumesces it expands to plug the can at the bottom. This blocks flames from entering the light can and possibly extending through any openings in the can; it also reduces the heat inside the can. Further, the intumescent gasket ring 790 extending about the light can intumesces. The metal sleeve 794 constrains the ring such that the only place it can expand while it intumesces is into the interface between the light can 712 and base 754. The constraining sleeve 794 also densifies the char such that the interface between the light can and base is not only plugged, but there is a strong thermal barrier at this interface.

Figure 20A:
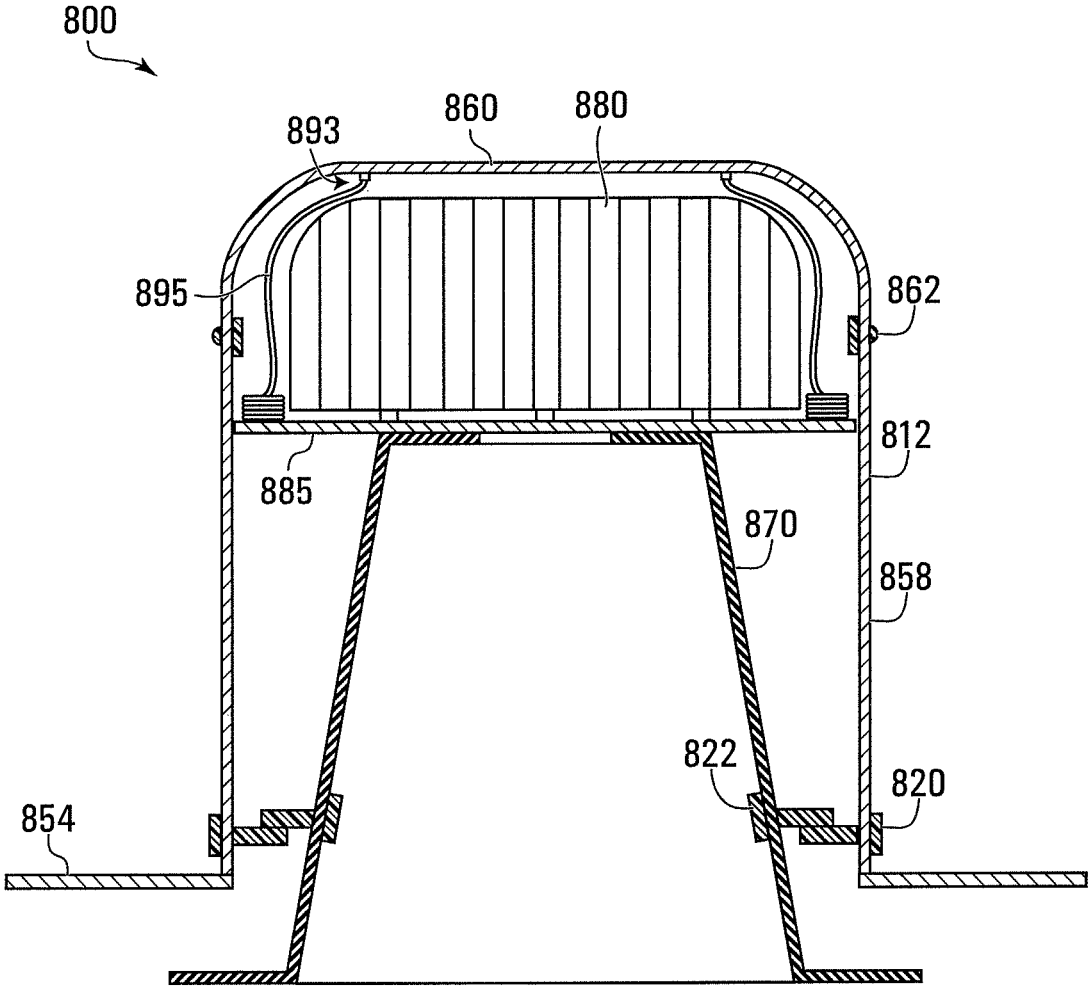
FIG. 20A is a schematic cross-sectional view of a downlight fixture in accordance with another embodiment.

Turning to FIG. 20A, LED downlight fixture 800 has a cylindrical light can 812 atop a base 854. The light can 812 has a body 858 shaped as a cylindrical sleeve and an end cap 860 which is joined to the body by rivets 862. Plastic T-shaped tabs 820 supported by the light can 812 have tongues projecting inwardly from the light can. Plastic T-shaped tabs 822 supported by a heat sink 870 have tongues projecting outwardly from the heat sink. The tabs 822 of the heat sink rest on the tabs 820 of the light can such that the heat sink 870 is supported within the light can 812. An LED light (not shown) is mounted within heat sink 870. A firestop element 880 is mounted to a metal support plate 885. One end 893 of each of a number of flexible cables 895 is mounted to the underside of the cap 860 of the light can 812 and the other end 897 (FIG. 20B) is mounted to the top of support plate 885. Loops of excess cable sit atop the support plate.

An intumescent ring and constraining metal sleeve (not shown) may surround the base of the light can as described in conjunction with FIGS. 12A and 12B.

In manufacture, tabs 820 are inserted into the light can 812. The heat sink is then moved into place within the light can and tabs 822 are inserted into the heat sink so that the tongues of tabs 822 overlie the tongues of tabs 820 whereby the heat sink is supported within the light can 812. Next, the firestop element 880 with its support plate 885 is set in place on the top of the heat sink. The cap 860 of the light can, which is joined to the support plate 885 by cables 895 is then brought into place on top of the body 858 of the can, looping excess cable onto the mounting plate in the process. Cap 860 is then riveted in place.

Figure 20B:
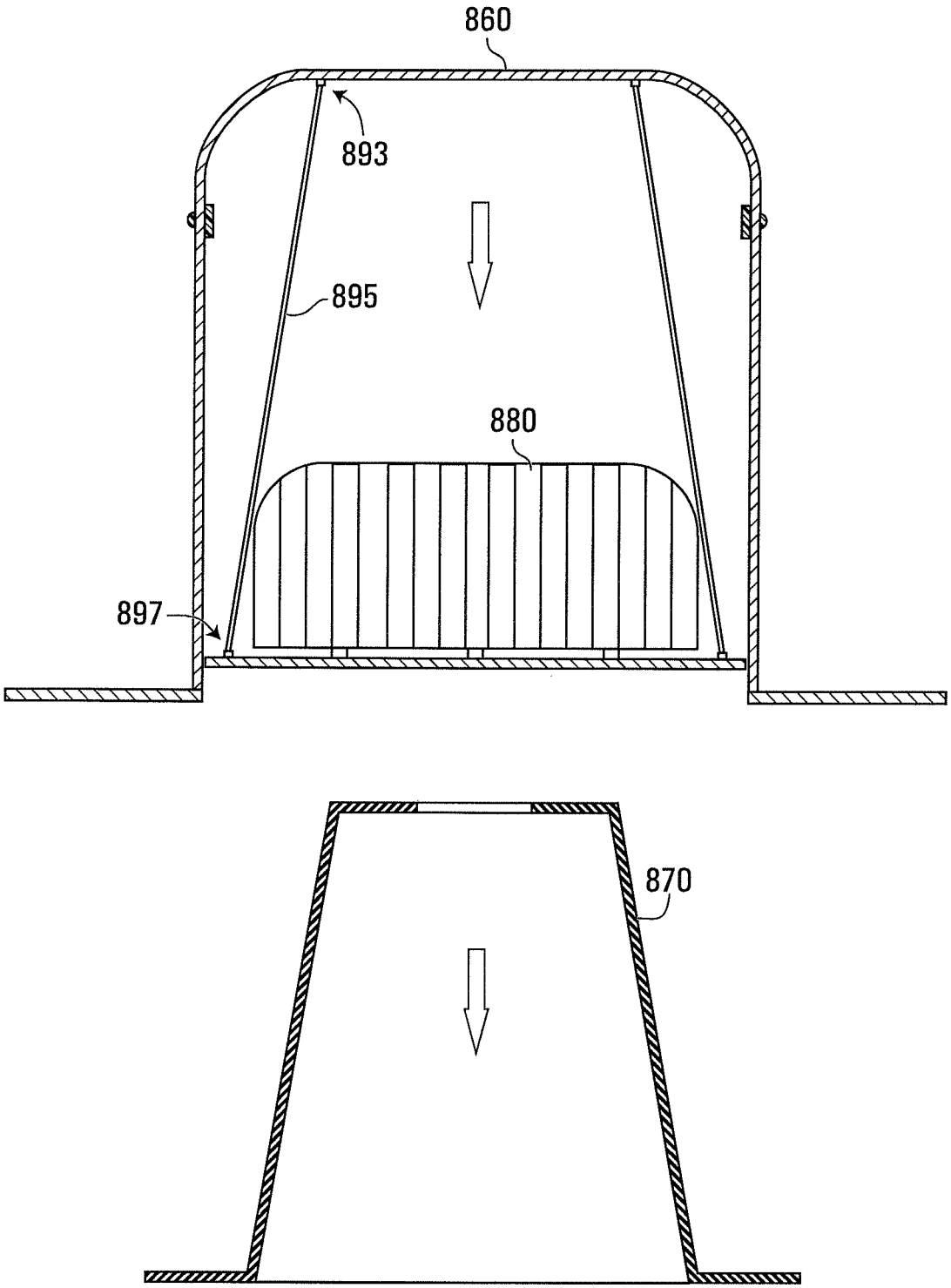
FIG. 20B is a schematic cross-sectional view of the downlight fixture of FIG. 20A showing a firestop element in a deployed position.
Figure 21:
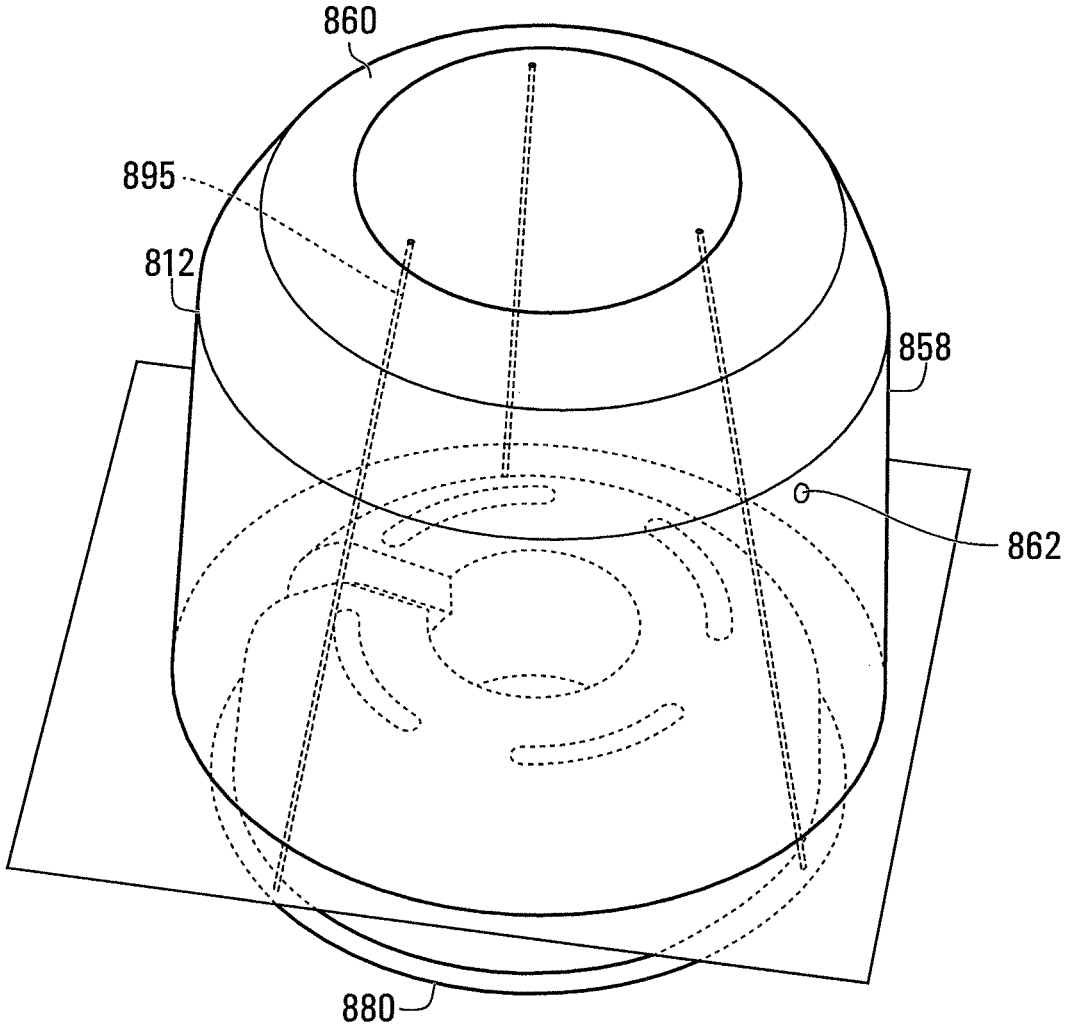
FIG. 21 is a top perspective view of the downlight fixture of FIG. 20B.

In use, in the event of a fire, tabs 820 and 822 melt or burn off. In consequence, heat sink 870 (with its LED light) is no longer supported within the light can 812 and it falls away, as illustrated in FIG. 20B. Since the firestop element 880 with its support plate 885 had rested upon the heat sink, it falls with the heat sink until arrested by the cables 895, as is illustrated in FIG. 20B and FIG. 21. The length of the cables is chosen so that the firestop element is arrested proximate the base of the light can. Thus, the cables act as limiters, limiting the fall of the firestop element and support plate. With the firestop element in this deployed position, as this element intumesces, it expands to plug the can at the bottom. This blocks flames from entering the light can and possibly extending through any openings in the can; it also reduces the heat inside the can.

Figure 22A:
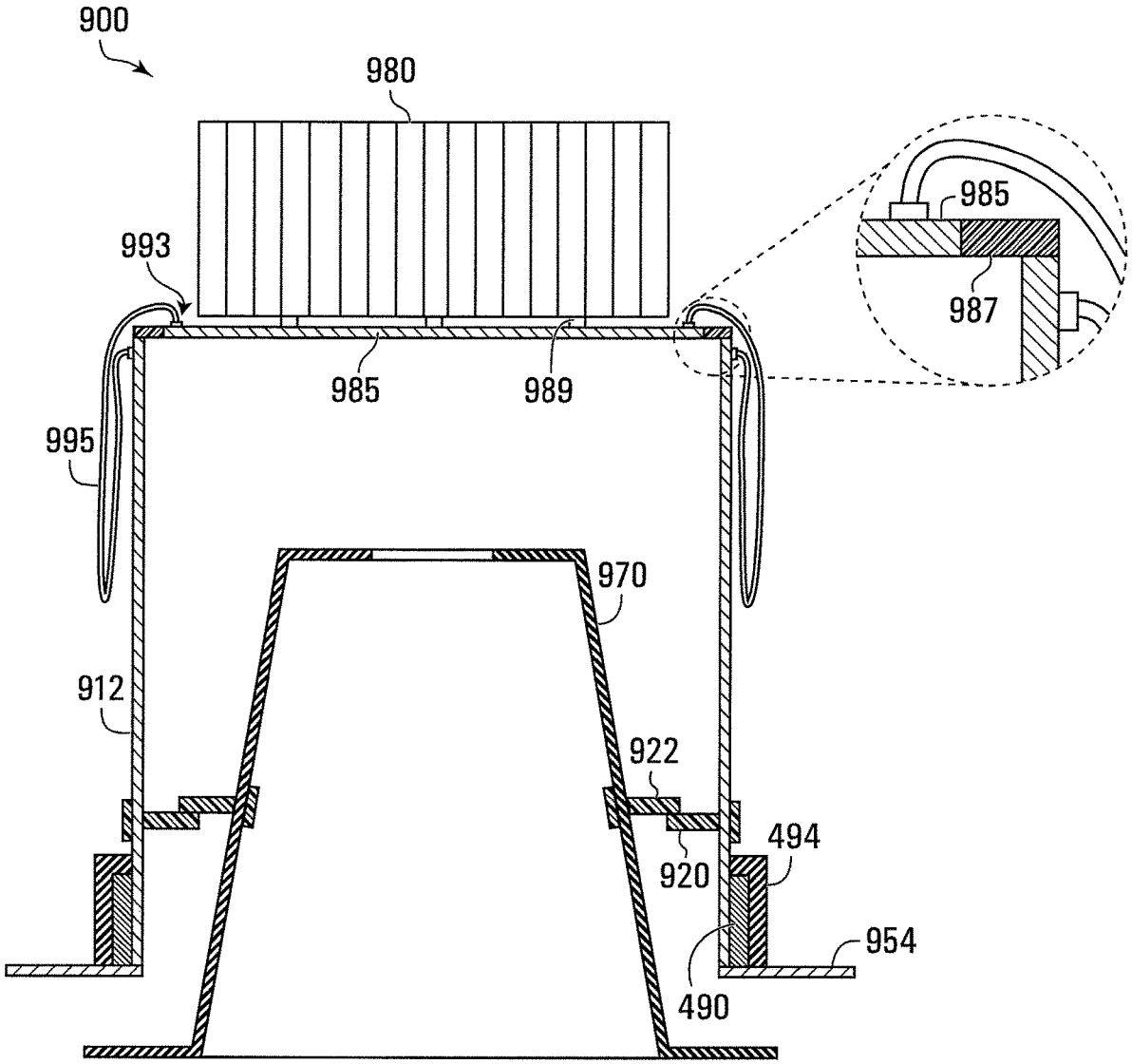
FIG. 22A is a schematic cross-sectional view of a downlight fixture in accordance with another embodiment.
Figure 22B:
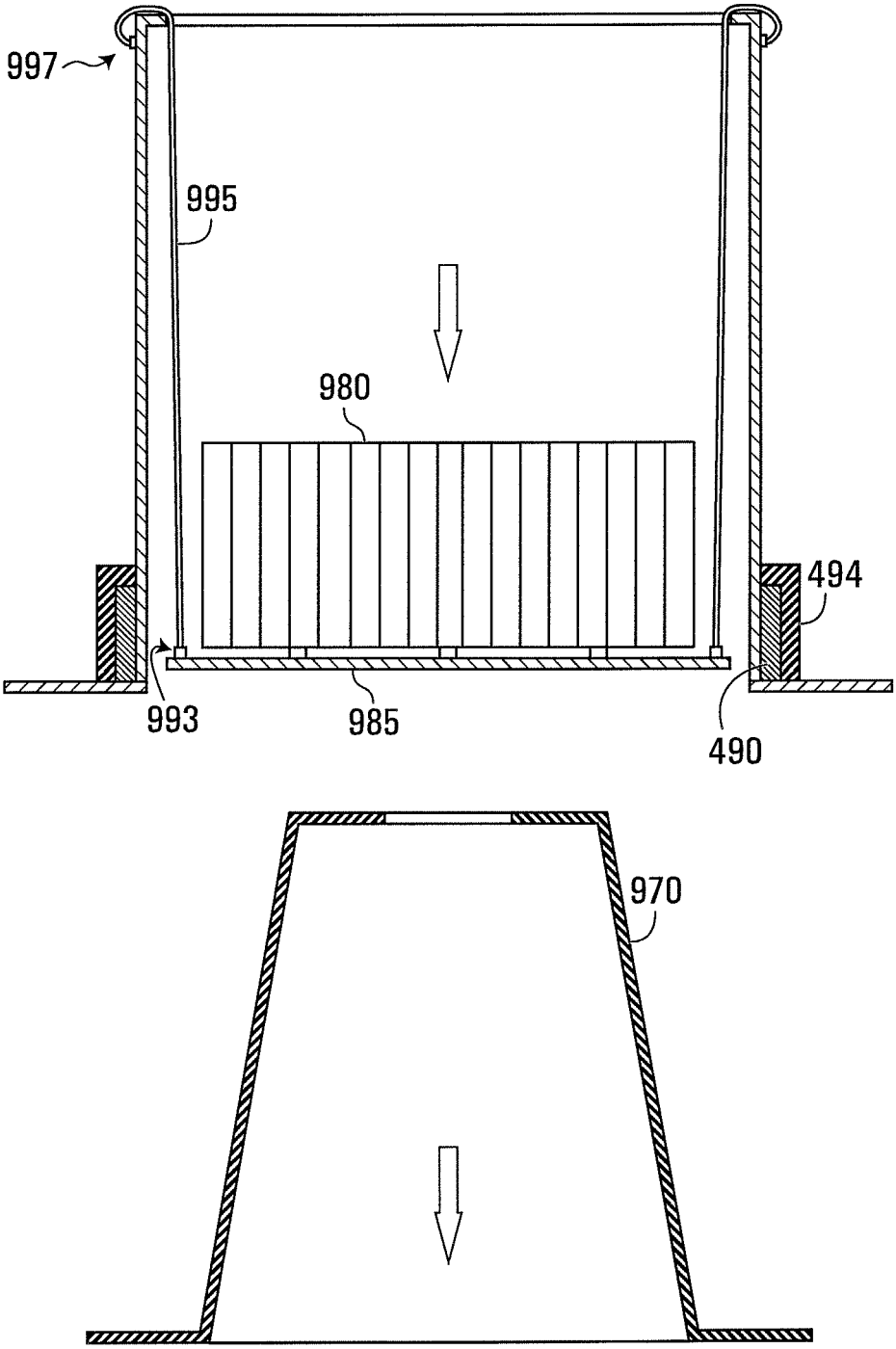
FIG. 22B is a schematic cross-sectional view of the downlight fixture of FIG. 22A showing a firestop element in a deployed position.

Referencing FIGS. 22A and 22B, in a further embodiment, downlight fixture 900 has a light can 912 on base 954. Meltable or flammable T-shaped tabs 920 supported by the light can 912 have tongues projecting inwardly from the light can. Meltable or flammable T-shaped tabs 922 supported by a heat sink 970 have tongues projecting outwardly from the heat sink. The tabs 922 of the heat sink rest on the tabs 920 of the light can such that the heat sink 970 is supported within the light can 912. An LED light (not shown) is mounted within heat sink 970.

Figure 23:
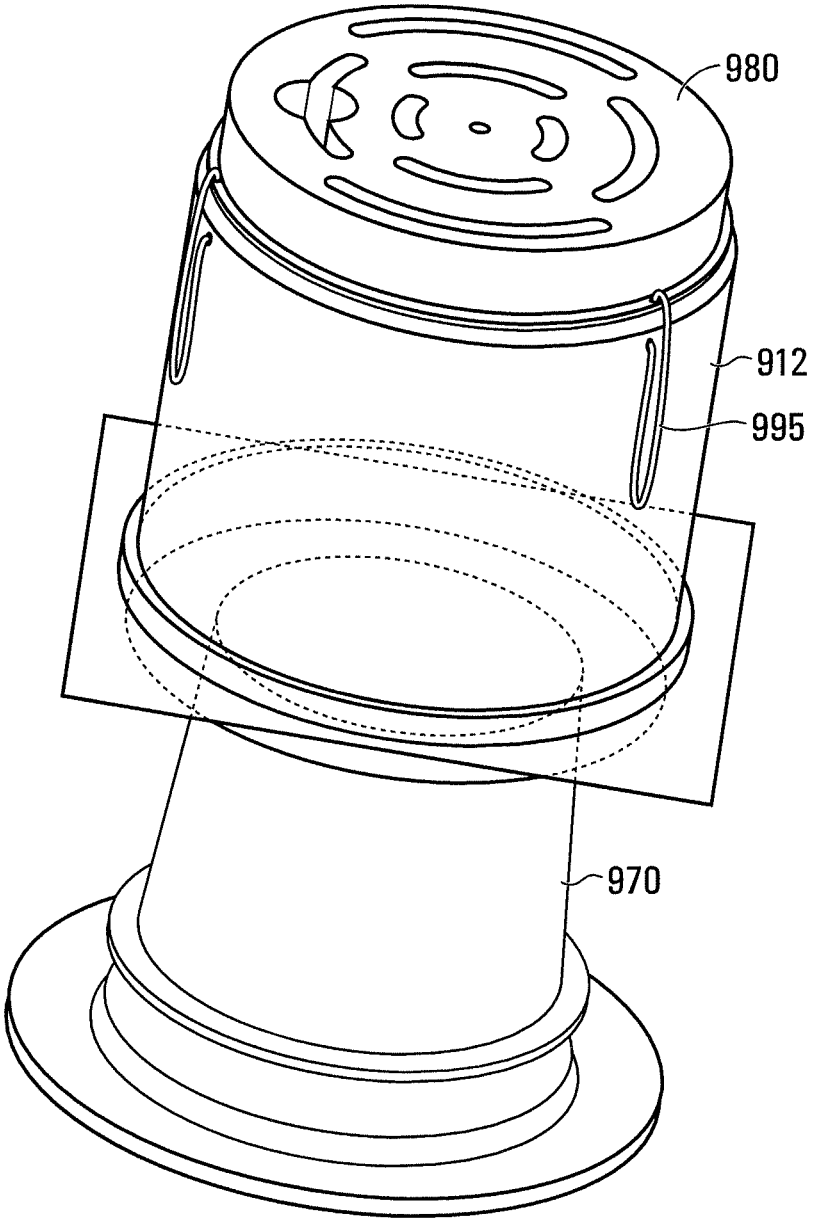
FIG. 23 is a top perspective view of the downlight fixture of FIG. 22B

The top of the light can 912 is a steel plate 985 surrounded by a fire sensitive element, namely meltable or flammable plastic ring 987. The ring sits atop the light can. The ring 987 can be held to the light can by rivets or screws and can be press fit to the steel plate. The plate 985 may be solid or, if helpful for heat dissipation, apertured. A firestop element 980, illustrated in perspective view in FIG. 23, is mounted to the steel plate by stand-off nibs 989. The stand-off nibs assist in heat dissipation. One end 993 of each of a number of flexible cables 995 is mounted to the top of plate 985 of the light can 912 and the other end 997 is mounted to the side of the light can. Excess cable drops down along the side of the light can.

An intumescent ring 490 and constraining metal sleeve 494 surround the base of the light can as described in conjunction with FIGS. 12A and 12B.

In manufacture, the tabs 920 are inserted into the light can 912 and the heat sink is then moved into place within the light can. Tabs 922 are then inserted into the heat sink so that the tongues of tabs 922 overlie the tongues of tabs 920 whereby the heat sink is supported within the light can 912.

In use, in the event of a fire, tabs 920 and 922 melt and/or burn off. In consequence, heat sink 970 (and its LED light) is no longer supported within the light can 912 and it falls away, as illustrated in FIGS. 22B and 23. Additionally, ring 987 melts or burns off. This removes the support for firestop element 980 and plate 985. Thus, the firestop element 980 and plate 985 fall with the heat sink until they are arrested by the cables 995, as is illustrated in FIG. 22B and FIG. 23. The length of the cables is chosen so that the firestop element is arrested proximate the base of the light can. With the firestop element in this deployed position, as this element intumesces, it expands to plug the can at the bottom. This blocks flames from entering the light can and possibly extending through any openings in the can; it also reduces the heat inside the can.

Figure 24A:
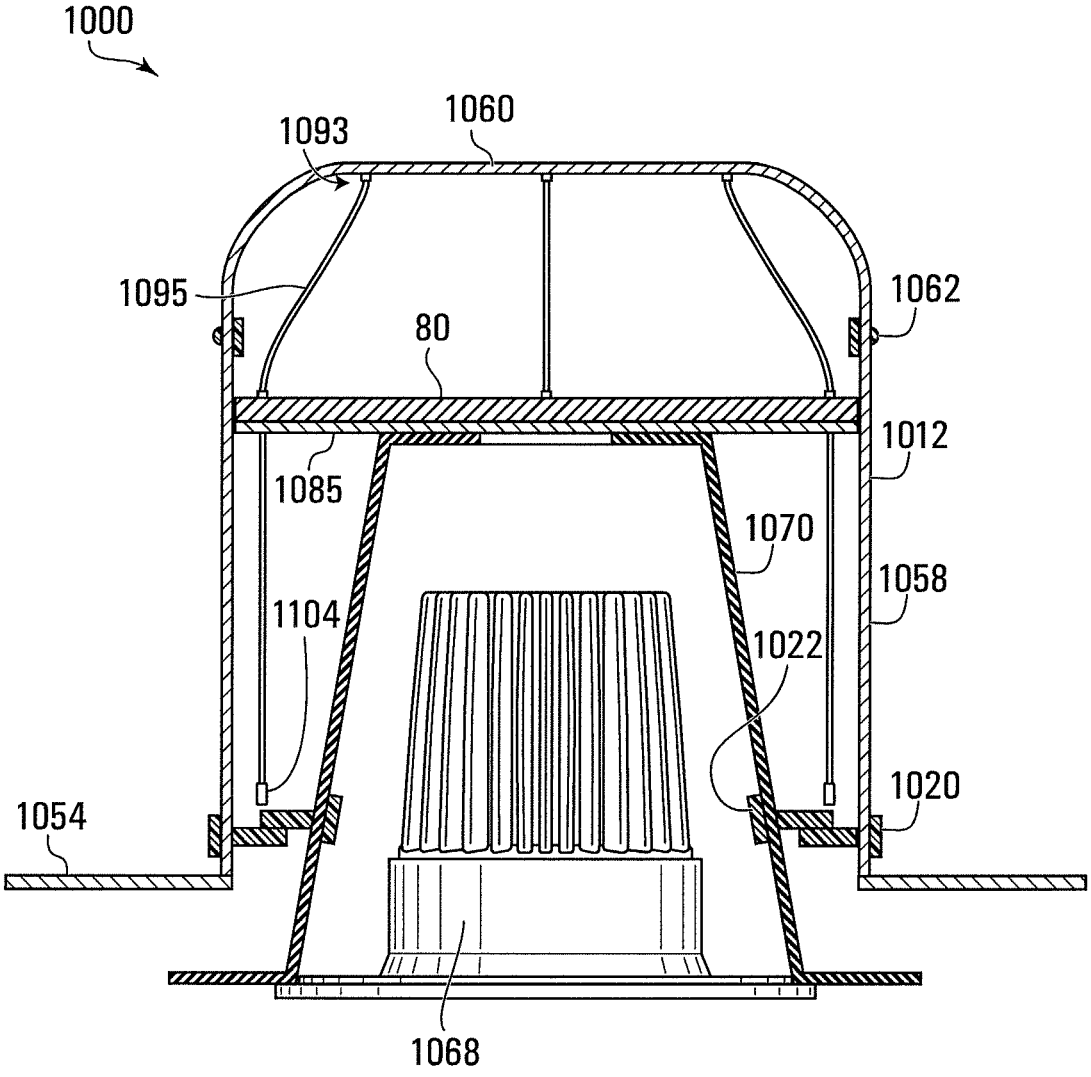
FIG. 24A is a schematic cross-sectional view of a downlight fixture in accordance with another embodiment.
Figure 24B:
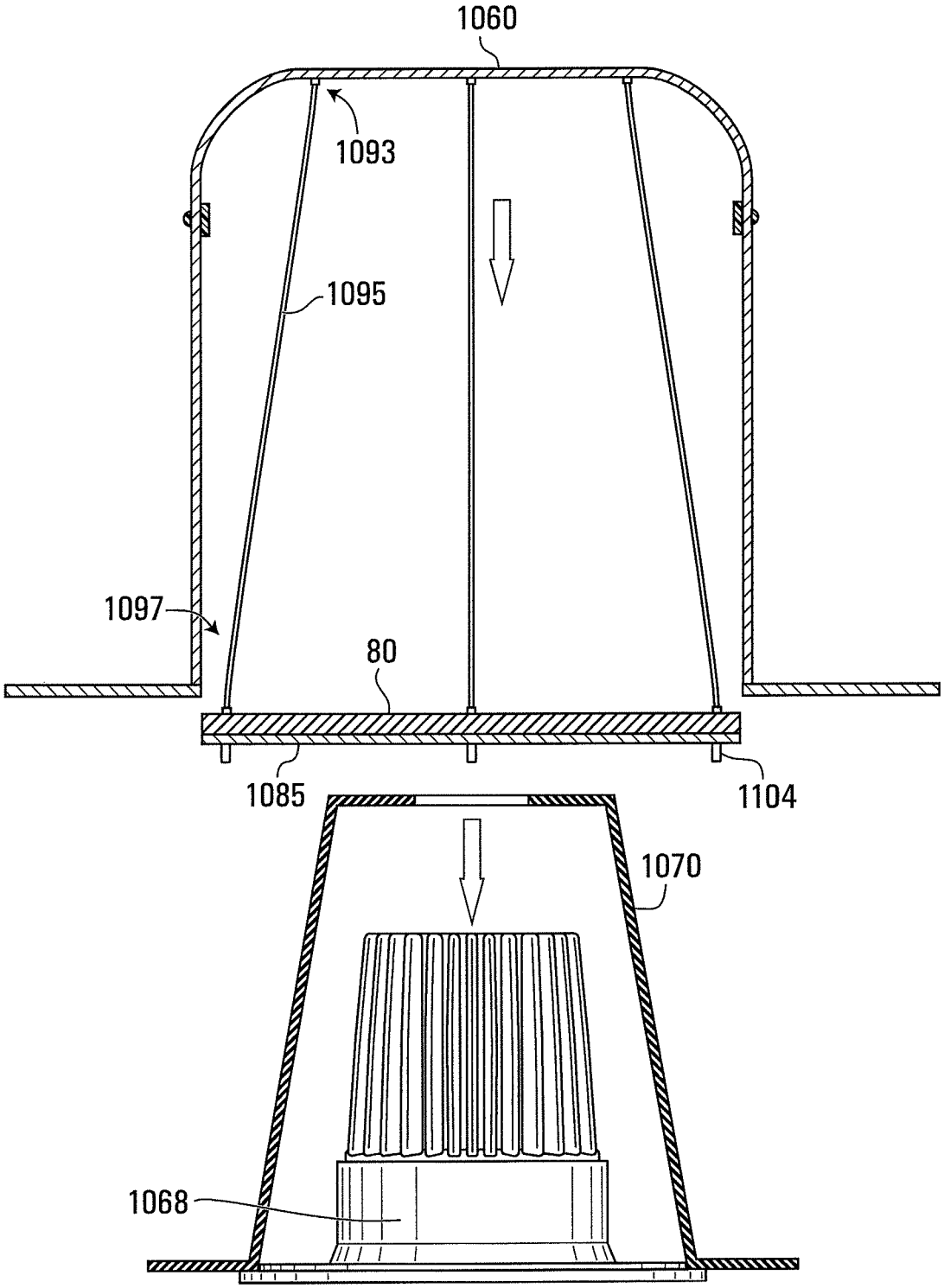
FIG. 24B is a schematic cross-sectional view of the downlight fixture of FIG. 24A showing a firestop element in a deployed position.
Figure 24C:
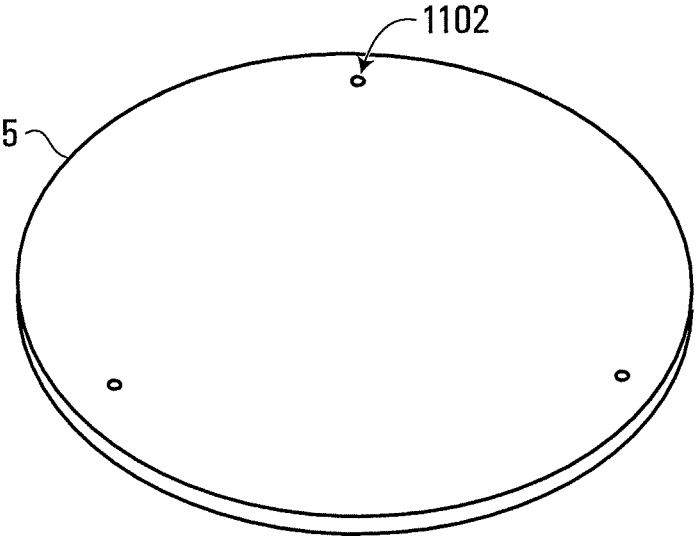
FIG. 24C is a top perspective view of a portion of the downlight fixture of FIG. 24A.

Turning to FIG. 24A, LED downlight fixture 1000 has a cylindrical metal light can 1012 atop a metal base 1054. The light can 1012 has a body 1058 shaped as a cylindrical sleeve and an end cap 1060 which is joined to the body by rivets 1062. Fire sensitive supports, namely plastic T-shaped tabs 1020 supported by the light can 1012, have tongues projecting inwardly from the light can. Further fire sensitive supports, namely plastic T-shaped tabs 1022 supported by a heat sink 1070, have tongues projecting outwardly from the heat sink. The tabs 1022 of the heat sink rest on the tabs 1020 of the light can such that the heat sink 1070 is supported within the light can 1012. An LED light 1608 is mounted within heat sink 1070 by any suitable means. A firestop element 80 rests on a metal support plate 1085. The firestop 80 element is illustrated in perspective view in FIG. 3 and was described hereinbefore in conjunction with that figure. As seen in FIG. 24C, the metal support plate 1085 is a disk having three peripheral openings 1100. One end 1093 of each of a number of flexible cables 1095 is attached to the underside of the cap 1060 of the light can 1012 by any suitable mechanism, such as by a screw (not shown) in the cap pinching the end of each cable against the cap. Each of these cables passes through one of the voids 88 in firestop 80 and one of the openings 1102 in support plate 1085 and then extends downwardly adjacent the inside wall of the light can, terminating in a bulbous end 1104 proximate the base of the light can. The bulbous end of each cable has a larger diameter than the holes 1102 through the support plate 1085.

An intumescent ring and constraining metal sleeve (not shown) may surround the base of the light can as described in conjunction with FIGS. 12A and 12B.

In manufacture, tabs 1020 are inserted into the light can 1012. The heat sink is then moved into place within the light can and tabs 1022 are inserted into the heat sink so that the tongues of tabs 1022 overlie the tongues of tabs 1020 whereby the heat sink is supported within the light can 1012. Next, the end 1093 of each cable 1085 may be threaded through a peripheral opening 1102 of plate 1085 and a void 88 of disk 80 and attached to the underside of the cap 1060 of the light can 1012. The firestop element 80 with its support plate 1085 can then be set in place on the top of the heat sink. The cap 1060 of the light can is then brought into place on top of the body 1058 of the can, allowing excess cable to move through disk and plate so that the bulbous cable ends hang proximate the base of the light can 1012. Cap 1060 is then riveted in place.

Figure 25:
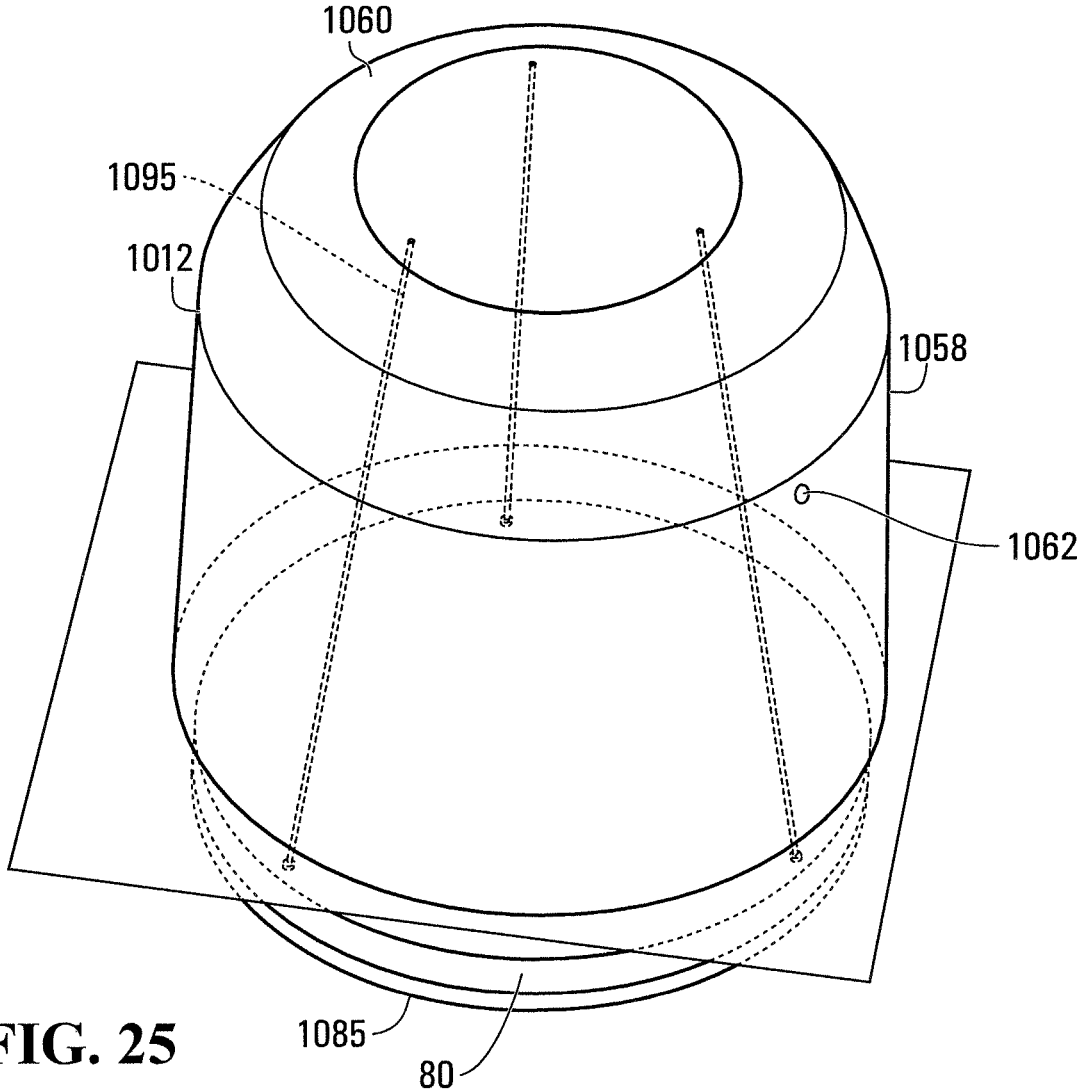
FIG. 25 is a top perspective view of the downlight fixture of FIG. 24B.

In use, in the event of a fire, tabs 1020 and 1022 melt or burn off. In consequence, heat sink 1070 (with its LED light 1068) is no longer supported within the light can 1012 and it falls away, as illustrated in FIG. 24B. Since the firestop element 80 with its support plate 1085 had rested upon the heat sink, it falls with the heat sink until the support plate 1085 abuts the bulbous ends 1104 of the cables 1095 whereupon the support plate and intumescent disk are arrested by the cables 1095, as is illustrated in FIG. 24B and FIG. 25. The length of the cables is chosen so that the firestop element when arrested protrudes just below the base of the light can. Thus, the cables act as limiters, limiting the fall of the firestop element and support plate. With the firestop element in this deployed position, as this element intumesces, it expands to plug the can at the bottom. This blocks flames from entering the light can and possibly extending through any openings in the can; it also reduces the heat inside the can.

Figure 26:
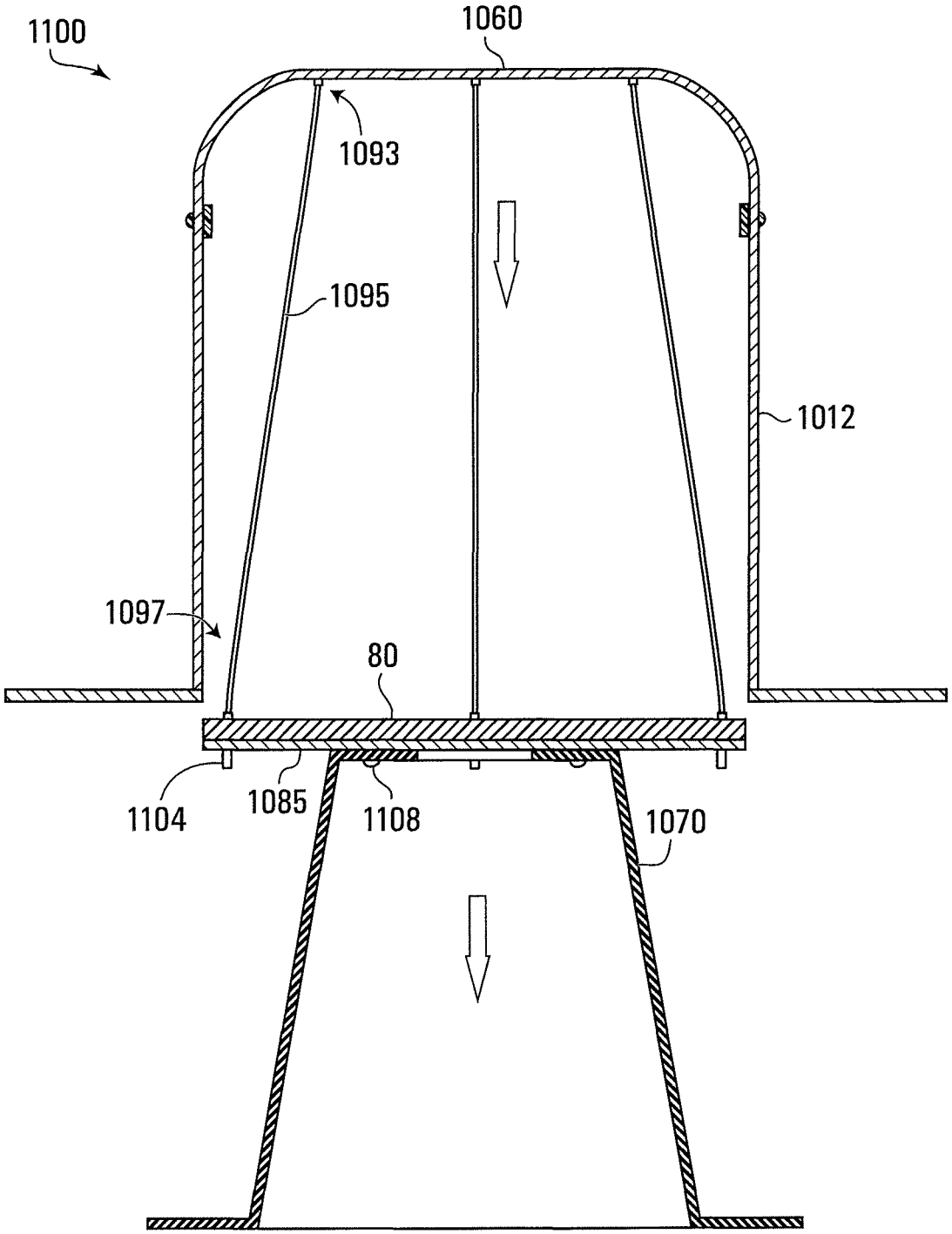
FIG. 26 is a schematic cross-sectional view of a downlight fixture in accordance with another embodiment showing a firestop element in a deployed position.

Turning to FIG. 26, LED downlight fixture 1100 is identical to LED downlight fixture 1000 of FIGS. 24A, 24B, and 25 except in one respect and so like parts have been designated with like reference numerals. The one difference between fixture 1100 and fixture 1000 is that in fixture 1100 the heat sink 1070 is joined to support plate 1085 by rivets 1108 or by any other suitable fastener. Thus, with light fixture 1100, in the event of fire, when the tabs retaining the heat sink 1070 within the light can 1012 fail, the heat sink and surmounted support plate 1085 with disk 80 fall until the support plate is arrested by the bulbous ends of the cables 1095. When the support plate is arrested, the heat sink, being joined to the support plate, is also arrested, as illustrated in FIG. 26. This embodiment has the advantage that the risk of the heat sink causing collateral damage during a fire is reduced.

Figure 27:
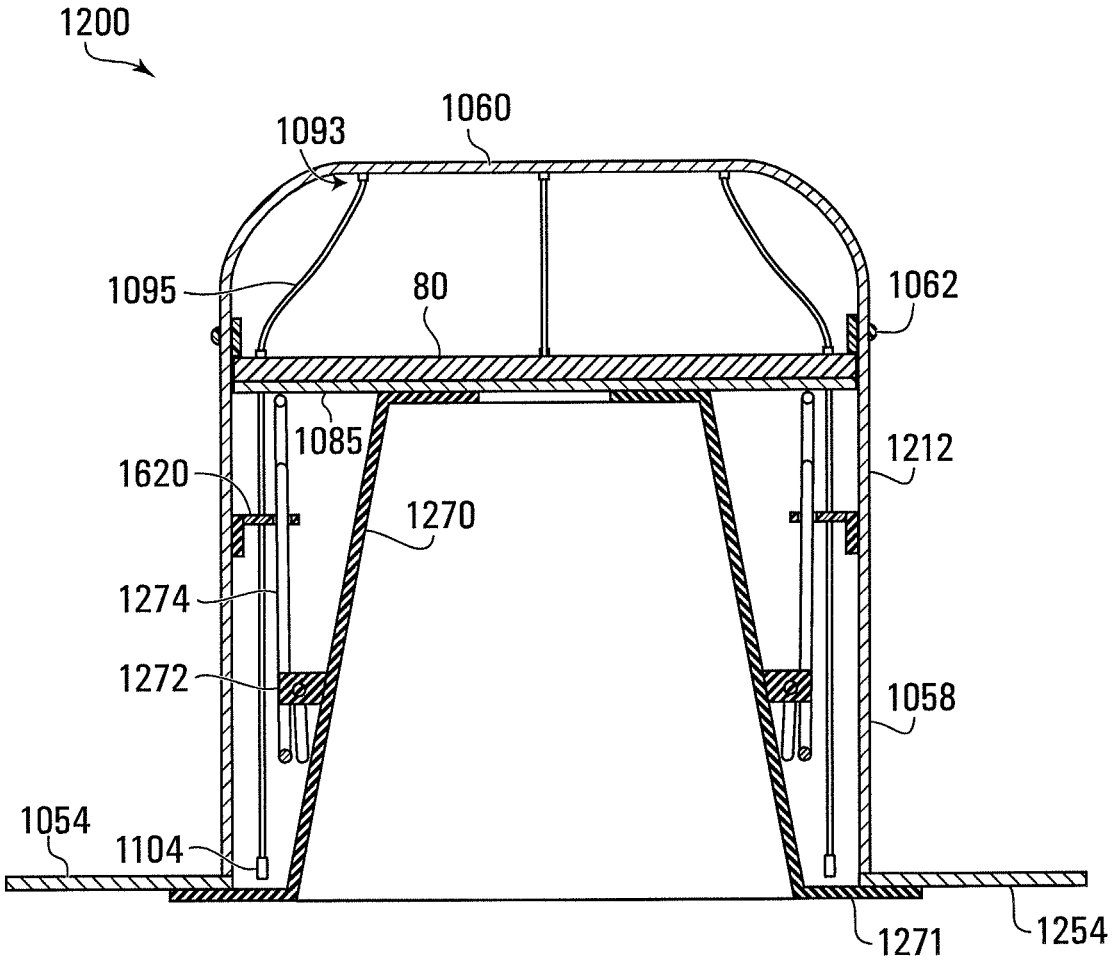
FIG. 27 is a schematic cross-sectional view of a downlight fixture in accordance with another embodiment.
Figure 27A:
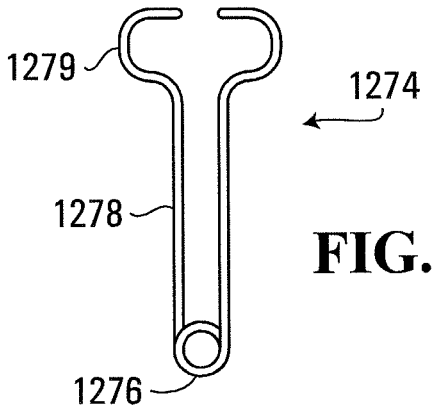
FIG. 27A is a fragmentary view showing a portion of FIG. 27.

With reference to FIG. 27, LED downlight fixture 1200 is similar to LED downlight fixture 1000 of FIGS. 24A, 24B, and 25 and like parts have been designated with like reference numerals. However, in fixture 1200, the tabs 1020, 1022 of fixture 1000 have been replaced with the meltable or flammable clips 1620 described in connection with FIGS. 16D to 16G. As such, clips 1620 are joined to, and project inwardly from, light can 1212. Further, the heat sink 1270 has a pair of ears 1272 with a spring clip 1274 mounted to each ear 1272. Each spring clip 1274 is identical to the spring clip 674 of FIG. 16B and, as such, as illustrated in FIG. 27A, has a medial spring section 1276 from which two legs 1278 extend that terminate in feet 1279.

To install the heat sink in the light can, the two legs of a spring clip are pinched together against the urging of spring section 1276, inserted into a clip 1620, and released. This is repeated with the second clip. The feet 1279 of the legs allow the heat sink to hang from the clips. The heat sink may then be pressed upwardly into the light can until the lip 1271 of the heat sink abuts base 1254, as shown in FIG. 27.

In use, in the event of a fire, the meltable or flammable base 1622 of clips 1620 melt and/or burn off. In consequence, heat sink 1270 with its spring clips 1274 (and its LED light) is no longer supported within the light can 1212 and it falls away. As described in conjunction with FIG. 24A, since the firestop element 80 with its support plate 1085 had rested upon the heat sink, it falls with the heat sink until the support plate 1085 abuts the bulbous ends 1104 of the cables 1095 whereupon the support plate and intumescent disk are arrested by the cables 1095.

The spring clips 1274 and clips 1620 that support the heat sink in the embodiment described in connection with FIGS. 27 and 27A could be substituted for the plastic tabs 520, 522 that support the heat sink in the embodiment of FIG. 14A, for the plastic clips 720 and tabs 722 that support the heat sink in the embodiment of FIG. 18A, for the plastic tabs 820, 822 that support the heat sink in the embodiment of FIG. 20A, or for the plastic tabs 920, 922 that support the heat sink in the embodiment of FIG. 22A.

Any of the embodiments described with a separate heat sink and LED light could be replaced with an LED light that incorporates a heat sink, as shown in FIGS. 16A to 16C.

The metal support plate on which a firestop element is mounted or upon which it rests in various of the embodiments assists in avoiding slump as the firestop element softens at elevated temperatures below the SET. For at least some firestop compositions, slump may not be problematic; in such circumstances, the support plate may not be needed.

The various firestop elements have been described as having voids to create ribs or other features which increase the surface area of the elements to improve the intumescing reaction time. In this regard, while the described firestop elements typically have regularly spaced identical features and voids, the features may differ and be irregularly spaced and reaction time can still be improved. Further, in some embodiments, reaction time of an element, and heat dissipation in the light can, may be sufficient without the addition of voids. Accordingly, it may sometimes be sufficient to provide a firestop element in the described embodiments which lacks voids.

The one or more fire sensitive supports which cease to support the firestop element in some embodiments have been described as meltable or flammable tabs or clips or as a ring. In other embodiments, different fire sensitive supports may be employed. For example, in some embodiments, the fire sensitive supports may be bimetallic elements which bend to a non-supporting position when sufficiently heated by a fire.

Other modifications will be apparent to one of skill in the art and, therefore, the invention is defined in the claims.

What is claimed is:

1. A downlight fixture comprising:

a light can;

a light mount within said light can;

a firestop element mounted to said light can by at least one fire sensitive support in a first position above said light mount and configured to release said firestop element from said first position on heating, said firestop element fabricated of a polymer intumescent composition; and at least one flexible cable joined to said light can to suspend said firestop element in a second position at an opening of said light can to plug said opening by intumescing.

2. The downlight fixture of claim 1 wherein said at least one flexible cable comprises a plurality of cables, each cable joined at one end to an upper end of said light can.

3. The downlight fixture of claim 2 further comprising an enlargement at another end of each said cable opposite said one end.

4. The downlight fixture of claim 3 further comprising a support plate underlying said firestop element, said support plate fixed to said cables.

5. The downlight fixture of claim 4 wherein said firestop element is a disk having a plurality of axial through slots and wherein each said cable extends through one of said axial through slots.

6. The fixture of claim 1 wherein said polymer intumescent composition comprises a polymer and a blowing agent.

7. The downlight fixture of claim 1, wherein said light can comprises a cap, and said at least one cable is fixed to said cap.

8. The downlight fixture of claim 7, wherein said light can comprises a generally cylindrical body and said cap is attached to said body.

9. The downlight fixture of claim 1, wherein said fire sensitive support comprises a plate held atop said light can with a plastic connector.

10. The downlight fixture of claim 9, wherein said plastic connector comprises a ring surrounding said plate.

11. The downlight fixture of claim 1, wherein said light mount is attached to said light can by a fire-sensitive light support, said fire-sensitive light support configured to release said light mount on heating.

12. The downlight fixture of claim 11, wherein said light mount comprises a heat sink.

13. The downlight fixture of claim 12, wherein said fire-sensitive light support is attached to said heat sink.

14. The downlight fixture of claim 13, comprising an LED light secured to said heat sink.

15. The downlight fixture of claim 11, wherein said light mount is configured to fall through said opening upon release by said fire-sensitive support.

* * * * *